US009327743B2

(12) United States Patent
Green et al.

(10) Patent No.: US 9,327,743 B2
(45) Date of Patent: May 3, 2016

(54) GUIDEWAY MOUNTED VEHICLE LOCALIZATION SYSTEM

(71) Applicant: Thales Canada Inc, Toronto, Ontario (CA)

(72) Inventors: Alon Green, Toronto (CA); Rodney Ignatius, Markham (CA); Firth Whitwam, Toronto (CA); Walter Kinio, Mississauga (CA); David Dimmer, Toronto (CA); Mircea Georgescu, Toronto (CA)

(73) Assignee: Thales Canada Inc, Toronto, Ontario (CA)

( * ) Notice: Subject to any disclaimer, the term of this patent is extended or adjusted under 35 U.S.C. 154(b) by 0 days.

(21) Appl. No.: 14/639,290

(22) Filed: Mar. 5, 2015

(65) Prior Publication Data

US 2015/0239482 A1 Aug. 27, 2015

Related U.S. Application Data

(63) Continuation-in-part of application No. 14/134,179, filed on Dec. 19, 2013.

(51) Int. Cl.
*B61L 25/00* (2006.01)
*B61L 25/02* (2006.01)
(Continued)

(52) U.S. Cl.
CPC ..... *B61L 25/026* (2013.01); *B61L 15/0063* (2013.01); *B61L 23/041* (2013.01); *B61L 25/021* (2013.01); *B61L 25/023* (2013.01); *B61L 25/028* (2013.01)

(58) Field of Classification Search
CPC ... B61L 25/026; B61L 25/023; B61L 25/028; B61L 25/021; B61L 25/00; B61L 25/02; B61L 25/025; B61L 25/041; B61L 25/043; B61L 25/06; B61L 25/065
See application file for complete search history.

(56) References Cited

U.S. PATENT DOCUMENTS 3,365,572 A * 1/1968 Strauss ..... B61L 23/34 246/167 D
5,893,043 A * 4/1999 Moehlenbrink ..... B61L 3/004 246/182 C (Continued)

FOREIGN PATENT DOCUMENTS

CH 693308 5/2003
CN 202186403 4/2012

(Continued)

OTHER PUBLICATIONS

Mockel, S. Scherer, et al., "Multi-sensor obstacle detection on railway tracks," Jun. 9, 2003, <http://ieeexplore.ieee.org/xpl/login.jsp?tp=&arnumber=1212880&url=http%3A%2F%2Fieeexplore.ieee.org%2Fxpls%2Fabs_all.jsp%3Farnumber%3D1212880>.

(Continued)

*Primary Examiner* — Jason C Smith
(74) *Attorney, Agent, or Firm* — Hauptman Ham, LLP

(57) ABSTRACT

A system comprises a speed detector, a marker sensor, a controller, a sensor unit, and a processor. The speed detector is configured to generate speed data associated with a movement of a vehicle. The marker sensor is configured to generate marker data based on a detection of an object along a wayside of a guideway. The controller is configured to calculate a distance the vehicle moved, generate location information, and generate an indication the vehicle is stationary. The sensor unit comprises an accelerometer, a gyroscope, and a magnetometer. The sensor unit is configured to generate sensor data based on information gathered by one or more of the accelerometer, the gyroscope, or the magnetometer. The processor is configured to process the sensor data to determine a vehicle position based on the sensor data and the location information. The controller is further configured to compare the location information with the vehicle position.

20 Claims, 11 Drawing Sheets

(51) Int. Cl.
*B61L 15/00* (2006.01)
*B61L 23/04* (2006.01)

(56) References Cited

U.S. PATENT DOCUMENTS

| | | | | |
|---|---|---|---|---|
| 6,011,508 | A * | 1/2000 | Perreault | B61L 3/225 246/122 R |
| 6,163,755 | A * | 12/2000 | Peer | B61L 23/041 340/436 |
| 6,402,094 | B1 * | 6/2002 | Beer | B61L 3/225 246/122 R |
| 6,417,765 | B1 * | 7/2002 | Capanna | B61L 23/041 246/166 |
| 2003/0222981 | A1 * | 12/2003 | Kisak | B61L 15/0027 348/148 |
| 2004/0056182 | A1 * | 3/2004 | Jamieson | B61L 23/041 250/221 |
| 2005/0065726 | A1 * | 3/2005 | Meyer | B61L 25/021 701/470 |
| 2005/0161554 | A1 * | 7/2005 | Lotz | B61F 19/06 246/166 |
| 2007/0170315 | A1 * | 7/2007 | Manor | B61L 23/041 246/167 R |
| 2012/0150386 | A1 * | 6/2012 | Armbrust | G01S 7/4026 701/36 |
| 2012/0274772 | A1 * | 11/2012 | Fosburgh | B61K 9/08 348/149 |
| 2013/0060520 | A1 * | 3/2013 | Amor | G01S 5/0018 702/154 |
| 2013/0261837 | A1 * | 10/2013 | Sharma | G08G 1/167 701/1 |
| 2013/0261856 | A1 * | 10/2013 | Sharma | B61L 25/025 701/19 |
| 2014/0054424 | A1 * | 2/2014 | Xu | B61L 23/18 246/122 R |
| 2014/0214247 | A1 * | 7/2014 | Myokei | B61L 15/0063 701/19 |
| 2015/0008293 | A1 * | 1/2015 | Hatazaki | B61L 27/0038 246/30 |
| 2015/0008294 | A1 * | 1/2015 | Desbordes | B61L 25/021 246/122 R |
| 2015/0088345 | A1 * | 3/2015 | Nandedkar | B61L 25/021 701/20 |
| 2015/0120101 | A1 * | 4/2015 | Kimura | B61L 27/0027 701/20 |
| 2015/0134155 | A1 * | 5/2015 | Kanner | G01B 7/125 701/19 |
| 2015/0166085 | A1 * | 6/2015 | Mongaya | B61L 3/00 246/2 S |
| 2015/0175178 | A1 * | 6/2015 | Ignatius | B61L 23/041 246/120 |
| 2015/0239482 | A1 * | 8/2015 | Green | B61L 25/026 246/122 R |

FOREIGN PATENT DOCUMENTS

| | | |
|---|---|---|
| CN | 103192850 | 7/2013 |
| DE | 19746970 | 4/1999 |
| DE | 102010046153 | 3/2012 |
| DE | 102012107918 | 5/2014 |
| EP | 1319751 | 2/2006 |
| EP | 2168839 | 3/2010 |
| EP | 2210791 | 7/2010 |
| WO | 02055362 | 7/2002 |
| WO | 03019233 | 3/2003 |
| WO | 2004028881 | 4/2004 |
| WO | 2006008292 | 1/2006 |
| WO | 2007033939 | 3/2007 |

OTHER PUBLICATIONS

Garcia et al., "Browse Conference Publications >Instrumentation and Measureme . . . ," Instrumentation and Measurement Technology Conference Proceedings, 2008. IMTC 2008. IEEE, May 12, 2008, <http://ieeexplore.ieee.org/xpl/login.jsp?tp=&arnumber=4547393&url=http%3A%2F%2Fieeexplore.ieee.org%2Fxpls%2Fabs_all.jsp%3Farnumber%3D4547393>.

Xianru Liu et al., "Advanced obstacles detection and tracking by fusing millimeter wave radar and image sensor data," Control Automation and Systems (ICCAS), 2010 International Conference, Oct. 27, 2010, <http://ieeexplore.ieee.org/xpl/login.jsp?tp=&arnumber=5669740&url=http%3A%2F%2Fieeexplore.ieee.org%2Fxpls%2Fabs_all.jsp%3Farnumber%3D5669740>.

A. M irabadi et al.,"Fault detection and Isolation in Multisensor Train Navigation Systems", UKACC International Conference on CONTROL '98, Sep. 1-4, 1998, Conference Publication No. 455, IEE, 1998, pp. 185-192.

International Search Report for corresponding International PCT Application No. PCT/IB2014/063531, dated Nov. 4, 2014.

* cited by examiner

GUIDEWAY MOUNTED VEHICLE LOCALIZATION SYSTEM

PRIORITY CLAIM AND CROSS-REFERENCE

This application is a continuation-in-part of U.S. patent application Ser. No. 14/134,179, filed Dec. 19, 2013, the entirety of which is hereby incorporated by reference.

BACKGROUND

Guideway mounted vehicles include communication train based control (CTBC) systems to receive movement instructions from wayside mounted devices adjacent to a guideway. The CTBC systems are used to determine a location and a speed of the guideway mounted vehicle. The CTBC systems determine the location and speed by interrogating transponders positioned along the guideway. The CTBC systems report the determined location and speed to a centralized control system or to a de-centralized control system through the wayside mounted devices.

The centralized or de-centralized control system stores the location and speed information for guideway mounted vehicles within a control zone. Based on this stored location and speed information, the centralized or de-centralized control system generates movement instructions for the guideway mounted vehicles.

When communication between the guideway mounted vehicle and the centralized or de-centralized control system is interrupted, the guideway mounted vehicle is braked to a stop to await a manual driver to control the guideway mounted vehicle. Communication interruption occurs not only when a communication system ceases to function, but also when the communication system transmits incorrect information or when the CTBC rejects an instruction due to incorrect sequencing or corruption of the instruction.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
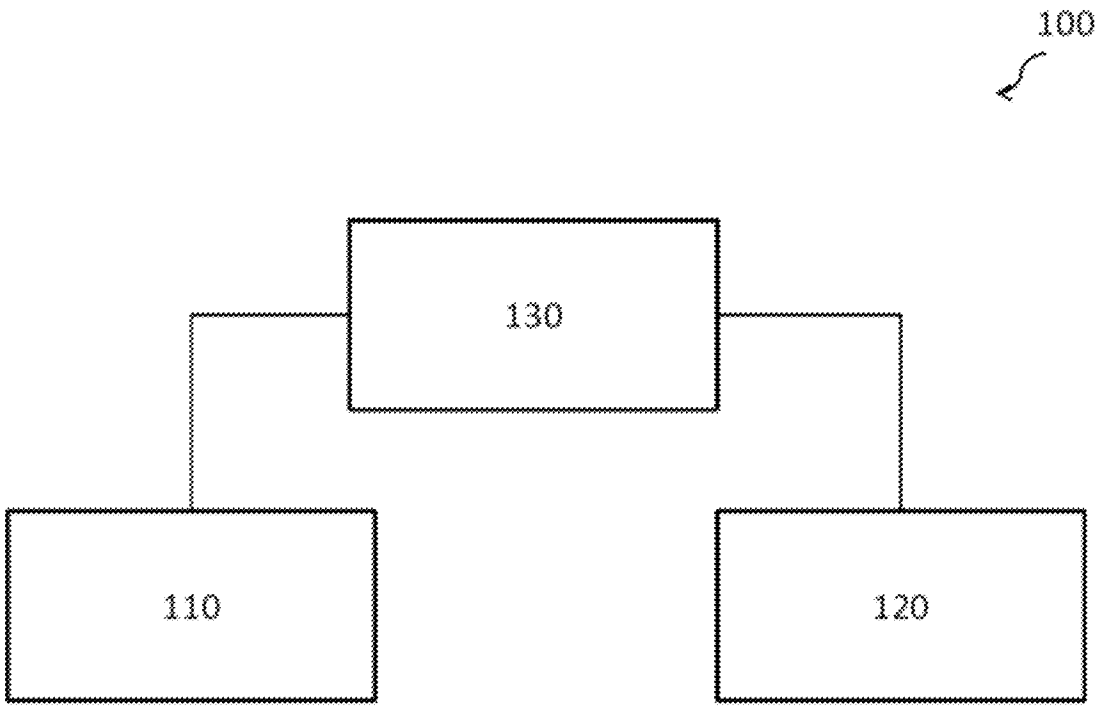
FIG. 1 is a high level diagram of a fusion sensor arrangement in accordance with one or more embodiments.

FIG. 1 is a high level diagram of a fusion sensor arrangement 100 in accordance with one or more embodiments. Fusion sensor arrangement 100 includes a first sensor 110 configured to receive a first type of information. Fusion sensor arrangement 100 further includes a second sensor 120 configured to receive a second type of information different from the first type of information. Fusion sensor arrangement 100 is configured to fuse information received by first sensor 110 with information received by second sensor 120 using a data fusion center 130. Data fusion center 130 is configured to determine whether an object is detected within a detection field of either first sensor 110 or second sensor 120. Data fusion center 130 is also configured to resolve conflicts between first sensor 110 and second sensor 120 arising when one sensor provides a first indication and the other sensor provides a contradictory indication.

In some embodiments, fusion sensor arrangement 100 is integrated with a vehicle on-board controller (VOBC) configured to generate movement instructions for a guideway mounted vehicle and to communicate with devices external to the guideway mounted vehicle. In some embodiments, fusion sensor arrangement 100 is separate from a VOBC and is configured to provide fused data to the VOBC.

First sensor 110 is configured to be attached to the guideway mounted vehicle. First sensor 110 includes a first detection field which includes an angular range in both a horizontal direction and in a vertical direction. The horizontal direction is perpendicular to a direction of travel of the guideway mounted vehicle and parallel to a top surface of a guideway. The vertical direction is perpendicular to the direction of travel of the guideway mounted vehicle and to the horizontal direction. The angular range in the horizontal direction facilitates detection of objects both along the guideway and along a wayside of the guideway. The angular range in the horizontal direction also increases a line of sight of first sensor 110 in situations where the guideway changes heading. The angular range in the vertical direction increases a line of sight of first sensor 110 in situations where the guideway changes elevation. The angular range in the vertical direction also facilitates detection of overpasses or other height restricting objects.

In some embodiments, first sensor 110 is an optical sensor configured to capture information in a visible spectrum. In some embodiments, first sensor 110 includes a visible light source configured to emit light which is reflected off objects along the guideway or the wayside of the guideway. In some embodiments, the optical sensor includes a photodiode, a charged coupled device (CCD), or another suitable visible light detecting device. The optical sensor is capable of identifying the presence of objects as well as unique identification codes associated with detected objects. In some embodiments, the unique identification codes include barcodes, alphanumeric sequences, pulsed light sequences, color combinations, geometric representations or other suitable identifying indicia.

In some embodiments, first sensor 110 includes a thermal sensor configured to capture information in an infrared spectrum. In some embodiments, first sensor 110 includes an infrared light source configured to emit light which is reflected off objects along the guideway or the wayside of the guideway. In some embodiments, the thermal sensor includes a Dewar sensor, a photodiode, a CCD or another suitable infrared light detecting device. The thermal sensor is capable of identifying the presence of an object as well as unique identifying characteristics of a detected object similar to the optical sensor.

In some embodiments, first sensor 110 includes a RADAR sensor configured to capture information in a microwave spectrum. In some embodiments, first sensor 110 includes a microwave emitter configured to emit electromagnetic radiation which is reflected off objects along the guideway or the wayside of the guideway. The RADAR sensor is capable of identifying the presence of an object as well as unique identifying characteristics of a detected object similar to the optical sensor.

In some embodiments, first sensor 110 includes a laser sensor configured to capture information within a narrow bandwidth. In some embodiments, first sensor 110 includes a laser light source configured to emit light in the narrow bandwidth which is reflected off objects along the guideway or the wayside of the guideway. The laser sensor is capable of identifying the presence of an object as well as unique identifying characteristics of a detected object similar to the optical sensor.

In some embodiments, first sensor 110 includes a radio frequency identification (RFID) reader configured to capture information in a radio wave spectrum. In some embodiments, first sensor 110 includes a radio wave emitter configured to emit an interrogation signal which is reflected by objects on the guideway or on the wayside of the guideway. The RFID reader is capable of identifying the presence of an object as well as unique identifying characteristics of a detected object similar to the optical sensor.

First sensor 110 is configured to identify an object and to track a detected object. Tracking of the detected object helps to avoid reporting false positives because rapid positional changes of the detected object enable a determination that first sensor 110 is not operating properly or that a transitory error occurred within the first sensor.

Second sensor 120 is configured to be attached to the guideway mounted vehicle. Second sensor 120 includes a second detection field which includes an angular range in both a horizontal direction and in a vertical direction. In some embodiments, the second detection field substantially matches the first detection field in order to reduce a risk of conflicts between first sensor 110 and second sensor 120. In some embodiments, the second detection field overlaps with a portion of the first detection field.

In some embodiments, second sensor 120 includes an optical sensor, a thermal sensor, a RADAR sensor, a laser sensor, or an RFID reader. In some embodiments, second sensor 120 is a different type of sensor from first sensor 110. For example, in some embodiments, first sensor 110 is an optical sensor and second sensor 120 is an RFID reader.

Utilizing first sensor 110 and second sensor 120 capable of detecting different types of information, e.g., different electromagnetic spectrums, enables fusion sensor arrangement 100 to reduce a risk of failing to detect an object along the guideway or the wayside of the guideway. Using sensors capable of detecting different types of information also enables confirmation of a detected object. For example, an optical sensor detects a bar code sign located on a wayside of the guideway. In instances where the bar code is defaced by dirt or graffiti such that the optical sensor cannot uniquely identify the bar code sign, an RFID reader may still be able to confirm the identifying information of the bar code sign based on an RF transponder attached to the bar code sign.

First sensor 110 and second sensor 120 are capable of identifying an object without additional equipment such as a guideway map or location and speed information. The ability to operate without additional equipment decreases operating costs for first sensor 110 and second sensor 120 and reduces points of failure for fusion sensor arrangement 100.

Data fusion center 130 includes a non-transitory computer readable medium configured to store information received from first sensor 110 and second sensor 120. Data fusion center 130 also includes a processor configured to execute instructions for identifying objects detected by first sensor 110 or second sensor 120. The processor of data fusion center 130 is further configured to execute instructions for resolving conflicts between first sensor 110 and second sensor 120.

Data fusion center 130 is configured to receive information from first sensor 110 and second sensor 120 and confirm detection of an object and whether the detected object contains identifying information. Data fusion center 130 is further configured to determine a distance from the fusion sensor arrangement 100 to the detected object, a relative speed of the object, a heading angle of the object and an elevation angle of the object.

Based on these determinations, data fusion center 130 is capable of tracking the detected object as the guideway mounted vehicle travels along the guideway to determine whether the object is on the guideway or on the wayside of the guideway. Tracking the object means that a location and relative speed of the object are regularly determined in a time domain. In some embodiments, the location and relative speed of the object are determined periodically, e.g., having an interval ranging from 1 second to 15 minutes. In some embodiments, the location and relative speed of the object are determined continuously.

Data fusion center 130 is also capable of comparing information from first sensor 110 with information from second sensor 120 and resolving any conflicts between the first sensor and the second sensor. Data fusion center 130 is configured to perform plausibility checks to help determine whether a sensor is detecting an actual object. In some embodiments, the plausibility check is performed by tracking a location of the object. In some embodiments, a relative change in the location of the object with respect to time which exceeds a threshold value results in a determination that the detected object is implausible. When an implausible determination is made, data fusion center 130 considers information received from the other sensor to be more reliable. In some embodiments, data fusion center 130 initiates a status check of a sensor which provides implausible information. In some embodiments, data fusion center 130 initiates a status check of a sensor which provides implausible information multiple times within a predetermined time period.

In some embodiments, when one sensor detects an object but the other sensor does not, data fusion center 130 is configured to determine that the object is present. In some embodiments, data fusion center 130 initiates a status check of the sensor which did not identify the object. In some embodiments, data fusion center 130 initiates a status check of the sensor which did not identify the object based on a type of object detected. For example, a thermal sensor is not expected to identify RFID transponder; therefore, the data fusion center 130 would not initiate a status check of the thermal sensor, in some embodiments.

In some embodiments, when one sensor detects a first type of object and the other sensor detects a second type of object different from the first type of object data fusion center 130 selects the object type based on a set of priority rules. In some embodiments, the priority rules give a higher priority to a certain type of sensor, e.g., a RADAR sensor over a laser sensor. In some embodiments, priority between sensor types is determined based on a distance between fusion sensor arrangement 100 and the detected object. For example, priority is given to the RADAR sensor if the distance between fusion sensor arrangement 100 and the detected object is greater than 100 meters (m) and priority is given to the laser sensor if the distance is less than 100 m or less.

Data fusion center 130 is a vehicle system. In some embodiments, data fusion center 130 has a safety integrity level 4 (SIL 4). In some embodiments, SIL 4 is based on International Electrotechnical Commission's (IEC) standard IEC 61508, in at least one embodiment. SIL level 4 means the probability of failure per hour ranges from $10^{-8}$ to $10^{-9}$.

Fusion sensor arrangement 100 is able to achieve a low rate of failure through the use of two separate sensors configured to detect objects using diverse detection techniques. In some embodiments, each sensor is designed to have a failure rate of about $3.8\times10^{-5}$ failures per hour, meaning a single failure every three years. A probability of two sensors having a failure at a same time is about $T\times3.6\times10^{-10}$ failures per hour, where T is an expected time interval between detected objects. In some embodiments, T ranges from about 2 minutes to about 40 minutes. In some embodiments, if fusion sensor arrangement 100 fails to detect an object within 2T, the fusion sensor arrangement is determined to be faulty and is timed out.

The above description is based on the use of two sensors, first sensor 110 and second sensor 120, for the sake of clarity. One of ordinary skill in the art would recognize that additional sensors are able to be incorporated into fusion sensor arrangement 100 without departing from the scope of this description. In some embodiments, redundant sensors which are a same sensor type as first sensor 110 or second sensor 120 are included in fusion sensor arrangement 100. In some embodiments, additional sensors of different sensor type from first sensor 110 and second sensor 120 are included in fusion sensor arrangement 100.

Data fusion center 130 is also capable of identifying location determining information such as the unique identification information for the object. Data fusion center 130 is able to provide information regarding whether the guideway mounted vehicle is aligned with an object, e.g., for positioning doors for passenger vehicles with platform openings.

Figure 2A:
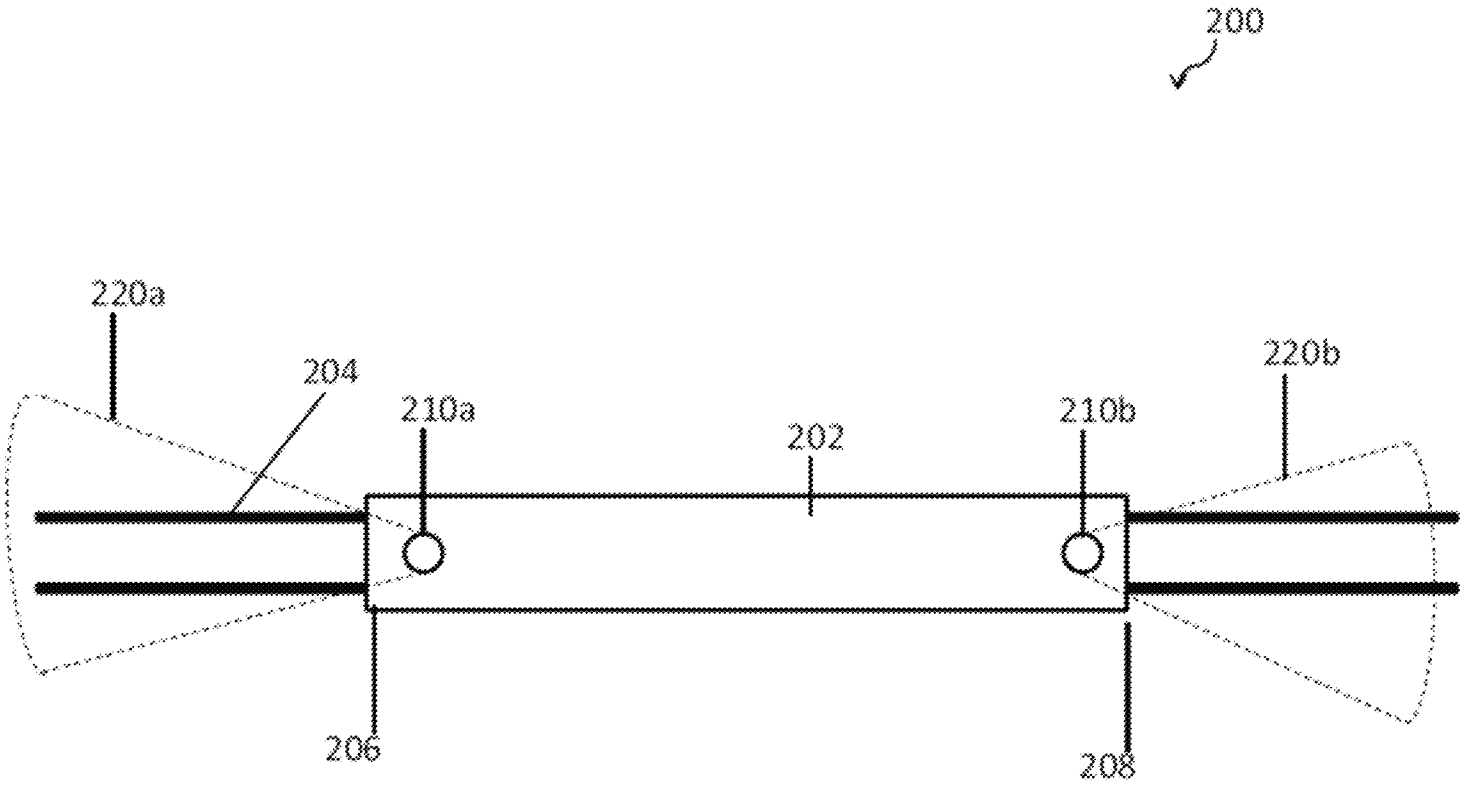
FIG. 2A is a high level diagram of a guideway mounted vehicle including fusion sensor arrangements in accordance with one or more embodiments.

FIG. 2A is a high level diagram of a guideway mounted vehicle 202 including fusion sensor arrangements 210*a* and 210*b* in accordance with one or more embodiments. Guideway mounted vehicle 202 is positioned on a guideway 204. Guideway mounted vehicle 202 has a first end 206 and a second end 208. A first fusion sensor arrangement 210*a* is located at first end 206 and a second fusion sensor arrangement 210*b* is located at second end 208. First fusion sensor arrangement 210*a* has a first field of detection 220*a* extending from first end 206. First field of detection 220*a* extends in an angular range in the horizontal direction and in the vertical direction. Second fusion sensor arrangement 210*b* has a second field of detection 220*b* extending from second end 208. Second field of detection 220*b* extends in an angular range in the horizontal direction and in the vertical direction.

Guideway mounted vehicle 202 is configured to traverse along guideway 204. In some embodiments, guideway mounted vehicle 202 is a passenger train, a cargo train, a tram, a monorail, or another suitable vehicle. In some embodiments, guideway mounted vehicle 202 is configured for bidirectional travel along guideway 204.

Guideway 204 is configured to provide a direction and heading of travel for guideway mounted vehicle 202. In some embodiments, guideway 204 includes two spaced rails. In some embodiments, guideway 204 includes a monorail. In some embodiments, guideway 204 is along a ground. In some embodiments, guideway 204 is elevated above the ground.

First end 206 and second end 208 are a corresponding leading end and trailing end of guideway mounted vehicle 202 depending on a direction of travel of the guideway mounted vehicle 202. By attaching fusion sensor arrangements 210*a* and 210*b* at both first end 206 and second end 208, either first detection field 220*a* or second detection field 220*b* extend in front of guideway mounted vehicle 202 in the direction of travel.

First fusion sensor arrangement 210*a* and second fusion sensor arrangement 210*b* are similar to fusion sensor arrangement 100 (FIG. 1). In some embodiments, at least one of first fusion sensor arrangement 210*a* or second fusion sensor arrangement 210*b* is integrated with a VOBC on guideway mounted vehicle 202. In some embodiments, both first fusion sensor arrangement 210*a* and second fusion sensor arrangement 210*b* are separate from the VOBC. In some embodiments, at least one of first fusion sensor arrangement 210*a* or second fusion sensor arrangement 210*b* is detachable from guideway mounted vehicle to facilitate repair and replacement of the fusion sensor arrangement.

Figure 2B:
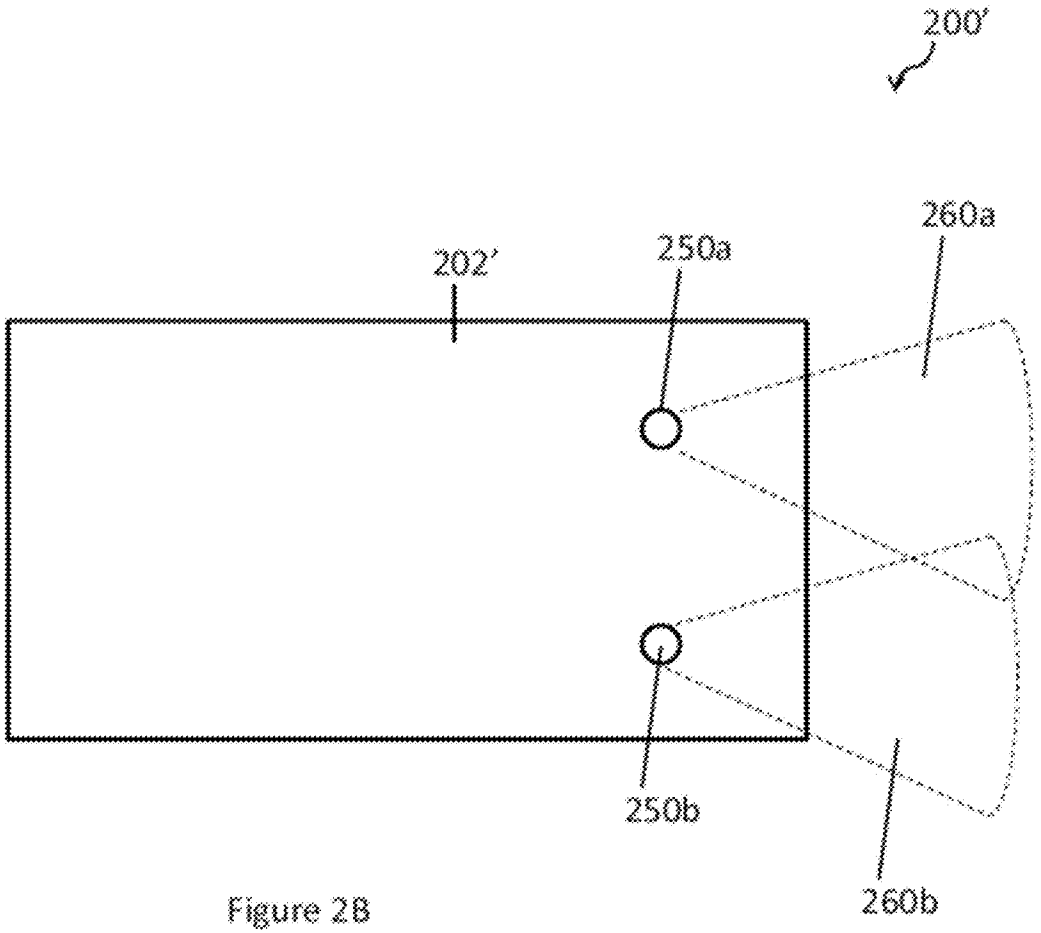
FIG. 2B is a high level diagram of a guideway mounted vehicle including fusion sensor arrangements in accordance with one or more embodiments.

FIG. 2B is a high level diagram of a guideway mounted vehicle 200' including fusion sensor arrangements 250*a* and 250*b* in accordance with one or more embodiments. FIG. 2B includes only a single end of guideway mounted vehicle 200' for simplicity. Guideway mounted vehicle 200' includes a first fusion sensor arrangement 250*a* and a second fusion sensor arrangement 250*b*. First fusion sensor arrangement 250*a* has a first field of detection 260*a*. Second fusion sensor arrangement 250*b* has a second field of detection 260*b*. First field of detection 260*a* overlaps with second field of detection 260*b*.

First fusion sensor arrangement 250*a* and second fusion sensor arrangement 250*b* are similar to fusion sensor arrangement 100 (FIG. 1). In some embodiments, first fusion sensor arrangement 250*a* has a same type of sensors as second fusion sensor arrangement 250*b*. In some embodiments, first fusion sensor arrangement 250*a* has at least one different type of sensor from second fusion sensor arrangement 250*b*. By using multiple fusion sensor arrangements 250*a* and 250*b*, a position of an objection is able to be triangulated by measuring a distance between each fusion sensor arrangement and the object.

Figure 3:
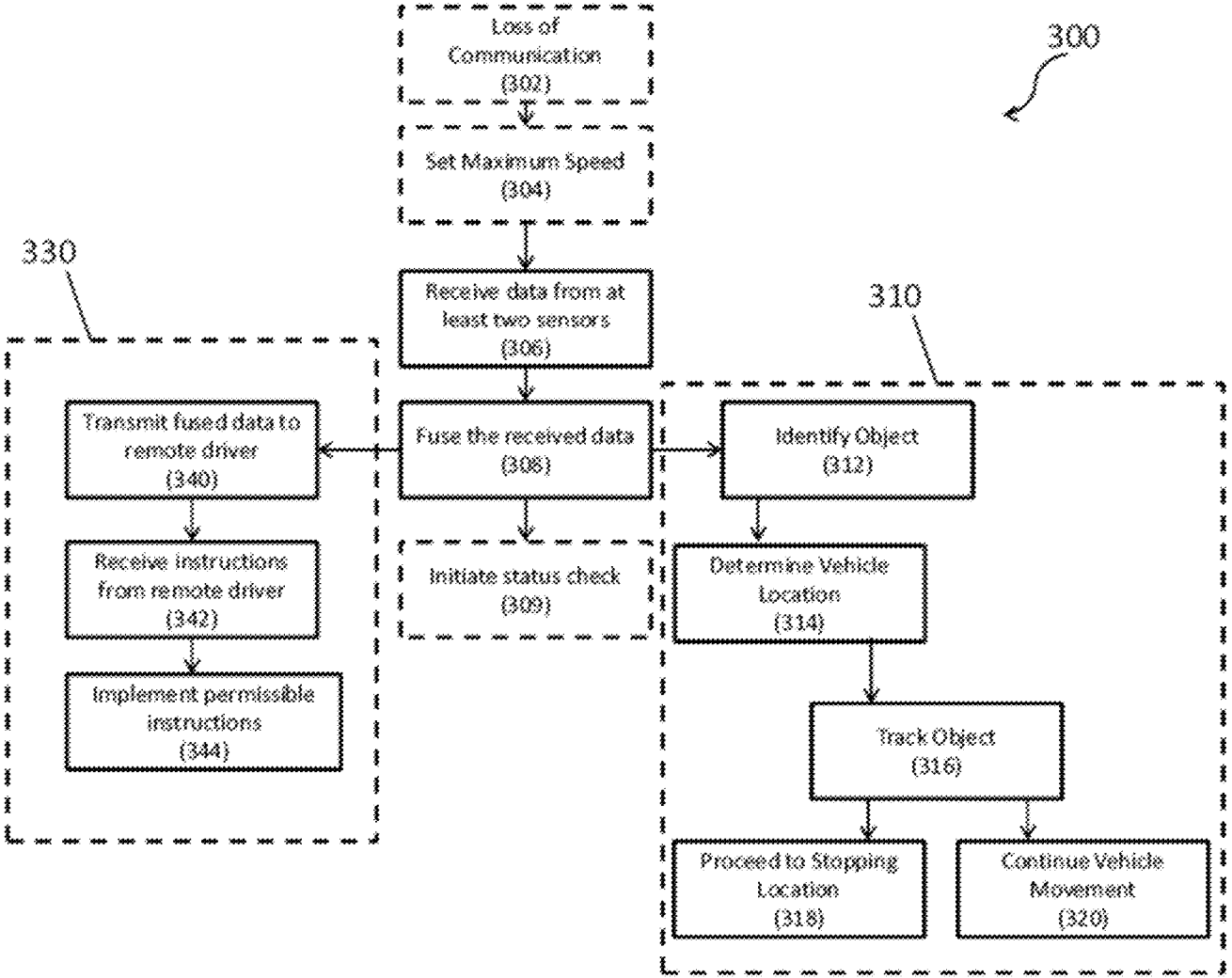
FIG. 3 is a flow chart of a method of controlling a guideway mounted vehicle using a fusion sensor arrangement in accordance with one or more embodiments.

FIG. 3 is a flow chart of a method 300 of controlling a guideway mounted vehicle using a fusion sensor arrangement in accordance with one or more embodiments. The fusion sensor arrangement in method 300 is used in combination with a VOBC. In some embodiments, the fusion sensor arrangement is integrated with the VOBC. In some embodiments, the fusion sensor arrangement is separable from the VOBC. In optional operation 302, the VOBC communication with a centralized or de-centralized control system is lost. In some embodiments, communication is lost due to a device failure. In some embodiments, communication is lost due to signal degradation or corruption. In some embodiments, communication is lost due to blockage of the signal by a terrain. In some embodiments, operation 302 is omitted. Operation 302 is omitted in some embodiments where the fusion sensor arrangement is operated simultaneously with instructions received from centralized or de-centralized communication system.

In some embodiments, information received through the fusion sensor arrangement is transmitted via the VOBC to the centralized or de-centralized communication system. In some embodiments, information received through the fusion sensor arrangement is provided to a remote driver to facilitate control of the guideway mounted vehicle by the remote driver. In some embodiments, the remote driver is able to receive images captured by the fusion sensor arrangement. In some embodiments, the remote driver is able to receive numerical information captured by the fusion sensor arrangement. In some embodiments, the VOBC is configured to receive instructions from the remote driver and automatically control a braking and acceleration system of the guideway mounted vehicle.

In optional operation 304, a maximum speed is set by the VOBC. The maximum speed is set so that the guideway mounted vehicle is capable of braking to a stop within a line of sight distance of the fusion sensor arrangement. In situations where the VOBC relies solely on the fusion sensor arrangement for the detection of objects along the guideway or the wayside of the guideway, such as during loss of communication with the centralized or de-centralized control system, the VOBC is able to determine a limit of movement authority (LMA) to the extent that the fusion sensor arrangement is capable of detecting objects. The VOBC is capable of automatically controlling the braking and acceleration system of the guideway mounted vehicle in order to control the speed of the guideway mounted vehicle to be at or below the maximum speed. In some embodiments, operation 304 is omitted if the VOBC is able to communicate with the centralized or de-centralized control system and is able to receive LMA instructions through the control system. The centralized and de-centralized control systems have information regarding the presence of objects along the guideway within an area of control of the control system. If the area of control extends beyond a line of sight of the fusion sensor arrangement, the VOBC is able to set a speed greater than the maximum speed in order for the guideway mounted vehicle to more efficiently travel along the guideway.

Data is received from at least two sensors in operation 306. The at least two sensors are similar to first sensor 110 or second sensor 120 (FIG. 1). In some embodiments, data is received by more than two sensors. At least one sensor of the at least two sensors is capable of a different type of detection from the at least another sensor of the at least two sensors. For example, one sensor is an optical sensor and the other sensor is an RFID reader. In some embodiments, at least one sensor of the at least two sensors is capable of a same type of detection as at least another sensor of the at least two sensors. For example, a redundant optical sensor is included in case a primary optical sensor fails, in some embodiments.

A field of detection of each sensor of the at least two sensors overlaps with each other. The field of detection includes an angular range in the horizontal direction and an angular range in the vertical direction. The angular range in the horizontal directions enables detection of objects along the guideway and the wayside of the guideway. The angular range in the vertical direction enables detection of objects which present a vertical blockage. The angular range in the vertical direction also enables detection of objects on a guideway above or below the guideway on which the guideway mounted vehicle is located.

In operation 308, the received data is fused together. The received data is fused together using a data fusion center, e.g., data fusion center 130 (FIG. 1). The data is fused together to provide a more comprehensive detection of objects along the guideway and the wayside of the guideway in comparison with data representing a single type of detection. In some embodiments, fusing the data includes confirming detection of an object and whether the detected object contains identifying information. In some embodiments, fusing the data includes determining a relative position, speed or heading of the detected object. In some embodiments, fusing the data together includes resolving conflicts between the received data. In some embodiments, fusing the data includes performing a plausibility check.

Resolving conflicts between the received data results is performed when data received from one sensor does not substantially match with data received by the other sensor. In some embodiments, a predetermine tolerance threshold is established for determining whether a conflict exists within the received data. The predetermined tolerance threshold helps to account for variations in the data which result from the difference in the detection type of the sensors. In some embodiments, a conflict is identified if an object is detected by one sensor but the object is not detected by the other sensor. In some embodiments, a status check of the sensor which did not identify the object is initiated. In some embodiments, a status check of the sensor which did not identify the object is initiated based on a type of object detected. For example, a thermal sensor is not expected to identify RFID transponder; therefore, a status check of the thermal sensor is not initiated, in some embodiments.

In some embodiments, conflicts between the received data related to the detected object are resolved by averaging the data received from the sensors. In some embodiments, resolving the conflict is based on a set of priority rules. In some embodiments, the priority rules give a higher priority to a certain type of sensor, e.g., a RFID reader over an optical sensor. In some embodiments, priority between sensor types is determined based on a distance between the fusion sensor arrangement and the detected object. For example, priority is given to the RADAR sensor if the distance between the fusion sensor arrangement and the detected object is greater than 100 meters (m) and priority is given to the optical sensor if the distance is 100 m or less.

Performing the plausibility check includes evaluating a relative change in the location of the object with respect to time. If the relative change in location exceeds a threshold value the object is determined to be implausible. When an implausible determination is made with respect to one sensor, data received from the other sensor is determined to be more reliable. In some embodiments, a status check of a sensor which provides implausible information is initiated. In some embodiments, a status check of a sensor which provides implausible information multiple times within a predetermined time period is initiated.

In optional operation 309, a status check of at least one sensor is initiated. In some embodiments, the status check is initiated as a result of a conflict between the received data. In some embodiments, the status check is initiated as a result of receiving implausible data. In some embodiments, the status check is initiated periodically to determine a health of a sensor prior to a conflict or receipt of implausible data. In some embodiments, periodic status checks are suspended while communication with the centralized or de-centralized control system is lost unless a conflict or implausible data is received.

In some embodiments, the VOBC receives the fused data and operates in conjunction with the centralized or de-centralized control to operate the guideway mounted vehicle. The VOBC receives LMA instructions from the centralized or de-centralized control. The LMA instructions are based on data collected with respect to objects, including other guideway mounted vehicles, within an area of control for the centralized or de-centralized control system. Based on the received LMA instructions, the VOBC will control the acceleration and braking system of the guideway mounted vehicle in order to move the guideway mounted vehicle along the guideway.

The VOBC receives the fused data from the fusion sensor arrangement and determines a speed and a location of the guideway mounted vehicle based on the detected objects. For example, a sign or post containing a unique identification is usable to determine a location of the guideway mounted vehicle. In some embodiments, the VOBC includes a guideway database which includes a map of the guideway and a location of stationary objects associated with unique identification information. In some embodiments, the VOBC is configured to update the guideway database to include movable objects based on information received from the centralized or de-centralized control system. By comparing the fused data with respect to an identifiable object with the guideway database, the VOBC is able to determine the location of the guideway mounted vehicle. In some embodiments, the VOBC determines a speed of the guideway mounted vehicle based on a change in location of an object detected in the fused data. The VOBC transmits the determined location and speed of the guideway mounted vehicle to the centralized or de-centralized control system.

In some embodiments, if communication with the centralized or de-centralized control system is lost, the VOBC performs autonomous operations 310. In operation 312, the VOBC identifies a detected object based on the fused data. In some embodiments, the VOBC identifies the detected object by comparing the fused data with information stored in the guideway database.

In some embodiments, the VOBC uses the identified object to determine a location of the guideway mounted vehicle in operation 314. In some embodiments, the VOBC determines the location of the guideway mounted vehicle based on unique identification information associated with the detected object. In some embodiments, the VOBC compares the unique identification information with the guideway database to determine the location of the guideway mounted vehicle.

The identified object is tracked in operation 316. Tracking the object means that a location and relative speed of the object are regularly determined in a time domain. In some embodiments, the object is tracked to determine whether the object will be on the guideway at a same location as the guideway mounted vehicle. In some embodiments, the object is tracked in order to provide location information for a non-communicating guideway mounted vehicle. In some embodiments, the location and relative speed of the object are determined periodically, e.g., having an interval ranging from 1 second to 15 minutes. In some embodiments, the location and relative speed of the object are determined continuously.

In operation 318, the VOBC provides instructions for the guideway mounted vehicle to proceed to a stopping location. In some embodiments, the stopping location includes a destination of the guideway mounted vehicle, a switch, a detected object on the guideway, coupling/de-coupling location, a protection area of a non-communicating guideway mounted vehicle or another suitable stopping location. A non-communicating guideway mounted vehicle is a vehicle which is traveling along the guideway which is under only manual operation, is experiencing a communication failure, lacks communication equipment or other similar vehicles. The VOBC autonomously generates instructions including LMA instructions. The LMA instructions are executed based on signals transmitted to the acceleration and braking system. In some embodiments, the LMA instructions are based on the location of the guideway mounted vehicle determined in operation 314 and the guideway database.

In some embodiments where the stopping location is a destination of the guideway mounted vehicle, the LMA instructions generated by the VOBC enable the guideway mounted vehicle to travel to a platform, station, depot or other location where the guideway mounted vehicle is intended to stop. In some embodiments, the VOBC controls the acceleration and braking system to maintain the guideway mounted vehicle at the destination until communication is re-established with the centralized or de-centralized control system or until a driver arrives to manually operate the guideway mounted vehicle.

In some embodiments where the stopping location is a switch, the LMA instructions generated by the VOBC cause the guideway mounted vehicle to stop at a heel of the switch if the switch is in a disturbed state. In some embodiments, the LMA instructions cause the guideway mounted vehicle to stop if the fused data fails to identify a state of the switch. In some embodiments, the LMA instructions cause the guideway mounted vehicle to stop if the fused data indicates a conflict regarding a state of the switch. In some embodiments, the LMA instructions cause the guideway mounted vehicle to stop if the most recent information received from the centralized or de-centralized control system indicated the switch is reserved for another guideway mounted vehicle.

In some embodiments where the stopping location is an object detected on the guideway, the LMA instructions generated by the VOBC cause the guideway mounted vehicle to stop a predetermined distance prior to reaching the detected object. In some embodiments, the object is a person, a disturbed switch, debris or another object along the guideway. In some embodiments, the VOBC uses the fused data to predict whether a detected object will be on the guideway when the guideway mounted vehicle reaches the location of the object. In some embodiments, the LMA instructions cause the guideway mounted vehicle to stop the predetermined distance prior to the object if the object is predicted to be on the guideway at the time the guideway mounted vehicle reaches the location of the object.

In some embodiments where the stopping location is a coupling/uncoupling location, the LMA instructions generated by the VOBC cause the guideway mounted vehicle to stop at the coupling/de-coupling location. The fused data is used to determine a distance between the guideway mounted vehicle and the other vehicle to be coupled/de-coupled. The VOBC is used to control the speed of the guideway mounted vehicle such that the coupling/de-coupling is achieved without undue force on a coupling joint of the guideway mounted vehicle. In some embodiments, the VOBC brings the guideway mounted vehicle to a stop while a separation distance between the two guideway mounted vehicles is less than a predetermined distance.

In some embodiments, where the stopping location is the protection area of a non-communicating guideway mounted vehicle, the LMA instructions generated by the VOBC stop the guideway mounted vehicle prior to entering the protection area. The protection area is a zone around the non-communicating guideway mounted vehicle to enable movement of the non-communicating guideway mounted vehicle with minimal interference with other guideway mounted vehicles. The protection area is defined by the centralized or de-centralized control system. In some embodiments, the LMA instructions cause the guideway mounted vehicle to stop prior to entering the protection area based on the most recent received information from the centralized or de-centralized control system.

One of ordinary skill in the art would recognize that additional stopping location and control processes are within the scope of this description.

In some embodiments, the VOBC continues movement of the guideway mounted vehicle along the guideway, in operation 320. The continued movement is based on a lack of a stopping location. In some embodiments, the VOBC controls reduction of the speed of the guideway mounted vehicle if a switch is traversed. The reduced speed is a switch traversal speed. The switch traversal speed is less than the maximum speed from operation 304. In some embodiments, operation 320 is continued until a stopping location is reached, communication is re-established with the centralized or de-centralized control system or a manual operator arrives to control the guideway mounted vehicle.

In some embodiments, following fusing of the received data in operation 308, LMA instructions are generated using remote driver operations 330. In operation 340, the fused data is transmitted to the remote driver, i.e., an operator who is not on-board the guideway mounted vehicle. In some embodiments, fused data is transmitted using the centralized or de-centralized control system. In some embodiments, the fused data is transmitted using a back-up communication system such as an inductive loop communication system, a radio communication system, a microwave communication system, or another suitable communication system. In some embodiments, the fused data is transmitted as an image. In some embodiments, the fused data is transmitted as alphanumerical information. In some embodiments, the fused data is transmitted in an encrypted format.

In operation 342, the VOBC receives instructions from the remote driver. In some embodiments, the VOBC receives instructions along a same communication system used to transmit the fused data. In some embodiments, the VOBC receives the instructions along a different communication system from that used to transmit the fused data. In some embodiments, the instructions include LMA instructions, speed instructions, instructions to traverse a switch, or other suitable instructions.

The VOBC implements permissible instructions in operation 344. In some embodiments, permissible instructions are instructions which do not conflict with the maximum speed set in operation 304, a switch traversal speed, traversing a disturbed switch, traversing a portion of the guideway where an object is detected or other suitable conflicts. In some embodiments, if the speed instructions from the remote driver exceed the maximum speed, the VOBC controls the guideway mounted vehicle to travel at the maximum speed. In some embodiments, if the speed instructions from the remote driver exceed the switch traversal speed, the VOBC controls the guideway mounted vehicle to travel at the switch traversal speed. In some embodiments, the VOBC controls the guideway mounted vehicle to traverse a switch which the fused data indicates as disturbed (or a conflict exists regarding the state of the switch) if the VOBC receives LMA instructions from the remote driver to traverse the switch. In some embodiments, the VOBC controls the guideway mounted vehicle to stop if the LMA instructions from the remote driver include traversing a portion of the guideway which includes a detected object.

One of ordinary skill in the art would recognize that an order of operations of method 300 is adjustable. One of ordinary skill in the art would also recognize that additional operations are includable in method 300, and that operations are able to be omitted form operation 300.

Figure 4:
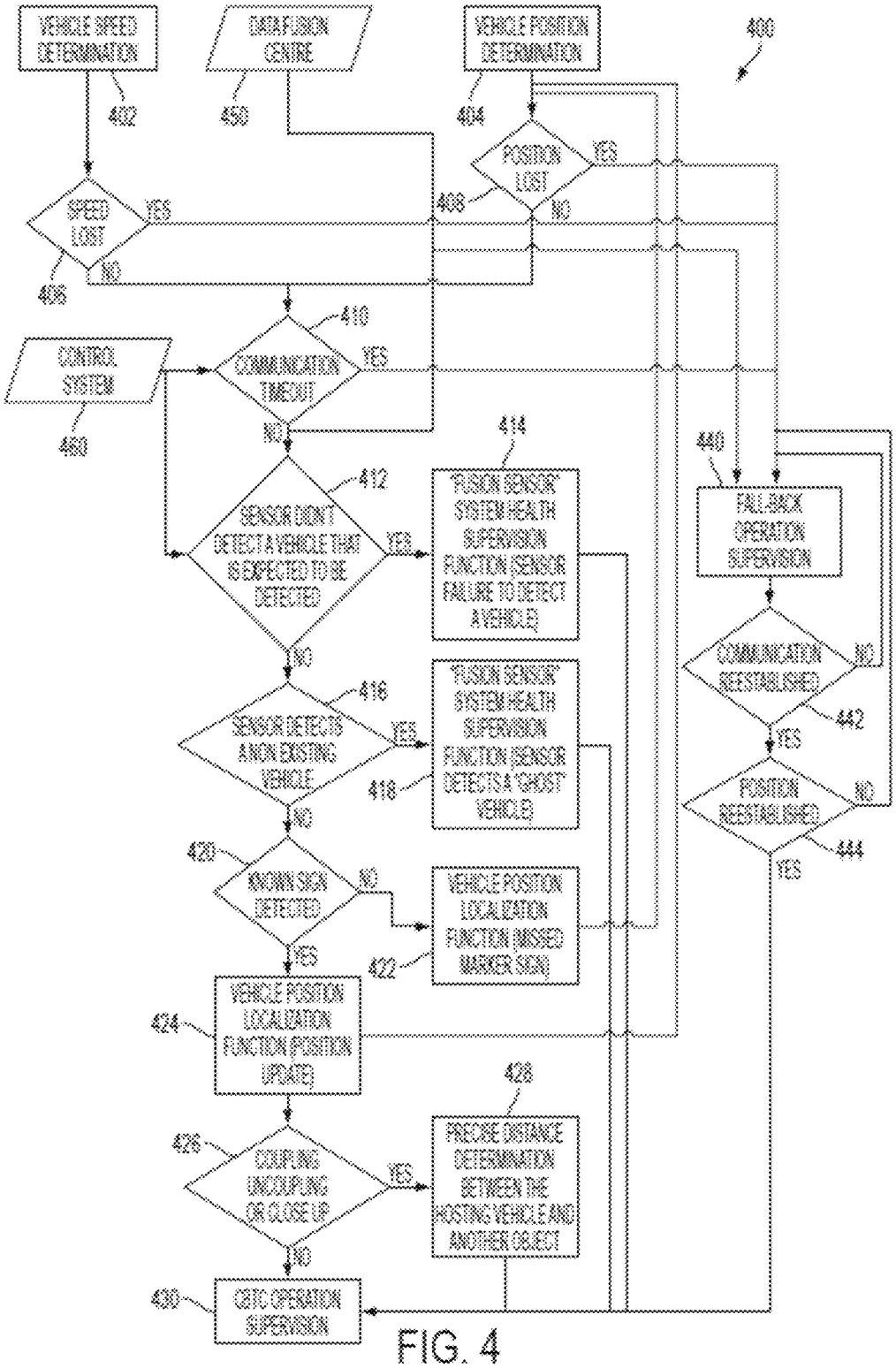
FIG. 4 is a functional flow chart for a method of determining a status of a fusion sensor arrangement in accordance with one or more embodiments.

FIG. 4 is a functional flow chart of a method 400 of determining a status of a fusion sensor arrangement in accordance with one or more embodiments. In some embodiments, method 400 is performed if operation 309 of method 300 (FIG. 3) is performed. In some embodiments, a VOBC causes method 400 to be executed periodically. In some embodiments, a data fusion center, e.g., data fusion center 130 (FIG. 1), causes method 400 to be executed upon determination of implausible data or upon receipt of conflicting data.

In operation 402, the VOBC determines a speed of the guideway mounted vehicle. In some embodiments, the VOBC determines the speed of the guideway based on information received from the centralized or de-centralized control system, information received from a data fusion center, e.g., data fusion center 130 (FIG. 1), measures taken from the guideway mounted vehicle (such as wheel revolutions per minute), or other suitable information sources. In some embodiments, the VOBC transmits the speed of the guideway mounted vehicle to the centralized or de-centralized control system.

In operation 404, the VOBC determines a position of the guideway mounted vehicle. In some embodiments, the VOBC determines the position of the guideway based on information received from the centralized or de-centralized control system, information received from a data fusion center, e.g., data fusion center 130 (FIG. 1), wayside transponders, or other suitable information sources. In some embodiments, the VOBC transmits the position of the guideway mounted vehicle to the centralized or de-centralized control system.

In operation 406, the VOBC determines whether the speed information is lost. In some embodiments, the speed information is lost due to failure of a communication system, failure of the data fusion center, an error within the VOBC or failure of another system.

In operation 408, the VOBC determines whether the position information is lost. In some embodiments, the speed information is lost due to failure of a communication system, failure of the data fusion center, an error within the VOBC or failure of another system.

If both of the speed information and the position information are still available, the VOBC determines if communication has timed out with the centralized or de-centralized control system, in operation 410. In some embodiments, the VOBC determines if communication has timed out by transmitting a test signal and determining whether a return signal is received. In some embodiments, the VOBC determines if communication has timed out base on an elapsed time since a last received communication. In some embodiments, the VOBC determines whether communication has timed out based whether an update to the guideway database was received from a control system 460.

If communication has not timed out, the VOBC determines whether a sensor of the fusion sensor arrangement did not detect a train that was expected to be detected in operation 412. The VOBC receives sensor information from data fusion center 450 and guideway database information from control system 460. Based on the guideway database information, the VOBC determines whether another guideway mounted vehicle is located at a position where the sensor of the fusion sensor arrangement should detect the other guideway mounted vehicle. Using the sensor information from data fusion center 450, the VOBC determines whether the other guideway mounted vehicle was detected. If a guideway mounted vehicle was available for detection and the sensor did not detect the guideway mounted vehicle, method 400 continues to operation 414.

In operation 414, the sensor of the fusion sensor arrangement is determined to be faulty. The VOBC provides instructions to data fusion center 450 to no longer rely on the faulty sensor. In some embodiments which include only two sensors in the fusion sensor arrangement, the VOBC ceases to rely on information provided by the fusion sensor arrangement. In some embodiments, the VOBC transmits a signal indicating a reason for determining the sensor as being faulty. In operation 414, the VOBC transmits a signal indicating the sensor failed to detect a guideway mounted vehicle, in some embodiments.

If no guideway mounted vehicle was available for detection or the sensor did detect a guideway mounted vehicle in operation 412, method 400 continues with operation 416. In operation 416, the VOBC determines whether the sensor detected a non-existing guideway mounted vehicle. Based on the guideway database information received from control system 460 and sensor information from data fusion center 450, the VOBC determines whether the sensor detected a guideway mounted vehicle where no guideway mounted vehicle is located. If a guideway mounted vehicle was detected, but the guideway dataset information indicates no guideway mounted vehicle was present, method 400 continues with operation 418.

In operation 418, the sensor of the fusion sensor arrangement is determined to be faulty. The VOBC provides instructions to data fusion center 450 to no longer rely on the faulty sensor. In some embodiments which include only two sensors in the fusion sensor arrangement, the VOBC ceases to rely on information provided by the fusion sensor arrangement. In some embodiments, the VOBC transmits a signal indicating a reason for determining the sensor as being faulty. In operation 418, the VOBC transmits a signal indicating the sensor detected a non-existent guideway mounted vehicle, in some embodiments.

If no guideway mounted vehicle was available for detection and the sensor did not detect a guideway mounted vehicle in operation 416, method 400 continues with operation 420. In operation 420, the VOBC determines whether the sensor detected a known wayside mounted object. Based on the guideway database information received from control system 460 and sensor information from data fusion center 450, the VOBC determines whether the sensor detected a wayside mounted object where a known wayside mounted object is located. If a known wayside mounted object was not detected, method 400 continues with operation 422.

In operation 422, the sensor of the fusion sensor arrangement is determined to be faulty. The VOBC provides instructions to data fusion center 450 to no longer rely on the faulty sensor. In some embodiments which include only two sensors in the fusion sensor arrangement, the VOBC ceases to rely on information provided by the fusion sensor arrangement. In some embodiments, the VOBC transmits a signal indicating a reason for determining the sensor as being faulty. In operation 422, the VOBC transmits a signal indicating the sensor failed to detect a known wayside mounted object, in some embodiments.

If the known wayside mounted object was detected in operation 420, method 400 continues with operation 424. In operation 424, the VOBC determines a location of the wayside mounted vehicle and transmits the determined location to control system 460 to update a location of the wayside mounted vehicle in the control system. In some embodiments, operation 424 is performed following operation 404. In some embodiments, operation 424 is performed every time a new location of the guideway mounted vehicle is determined.

In operation 426, the VOBC determines whether the guideway mounted vehicle is involved in a coupling/de-coupling process. The VOBC determines whether the guideway mounted vehicle is involved in the coupling/de-coupling process based on the sensor information from fusion data center 450 and the guideway database information from control system 460. The VOBC determines whether another guideway mounted vehicle is located within a coupling proximity to the guideway mounted vehicle. If the VOBC determines that the guideway mounted vehicle is involved in a coupling/de-coupling process, method 400 continues with operation 428.

In operation 428, the VOBC determine a precise distance between the guideway mounted vehicle and the other guideway mounted vehicle. The VOBC uses the sensor information and the guideway database information to determine the precise distance. In some embodiments, the VOBC sends instructions to data fusion center 450 to increase resolution of the sensor information. In some embodiments, the VOBC sends instructions to the acceleration and braking system to reduce the speed of the guideway mounted vehicle so that the location of the guideway mounted vehicle has a decreased rate of change. In some embodiment, the VOBC request more frequent update of the guideway database information from control system 460 to better determine a relative position of the other guideway mounted vehicle.

If the VOBC determines the guideway mounted vehicle is not involved in a coupling/de-coupling process, method 400 continues with operation 430. In operation 430, the VOBC continues to operate the guideway mounted vehicle in coordination with control system 460. In some embodiments, the VOBC uses the sensor information from data fusion center 450 in conjunction with information from control system 460. In some embodiments, the VOBC does not rely on the sensor information from data fusion center 450 in operation 430.

Returning to operations 406, 408 and 410, if the speed of the guideway mounted vehicle or the location of the guideway mounted vehicle is lost, or if communication with control system 460 has timed out, method 400 continues with operation 440. In operation 440, the VOBC relies on a fallback operation supervision to operate the guideway mounted vehicle. In some embodiments, the VOBC relies on sensor information from data fusion center 450 to operate the guideway mounted vehicle. In some embodiments, the VOBC performs in a manner similar to method 300 (FIG. 3) to operate the guideway mounted vehicle.

In operation 442, the VOBC determines whether communication with control system 460 is re-established. If communication with control system 460 is re-established, method 400 continues with operation 444. If communication with control system 460 is no re-established, method 400 returns to operation 440.

In operation 444, the VOBC determines whether the location of the guideway mounted vehicle is re-established. If the location of the guideway mounted vehicle is re-established, method 400 continues with operation 430. If the location of the guideway mounted vehicle is not re-established, method 400 returns to operation 440.

Figure 5:
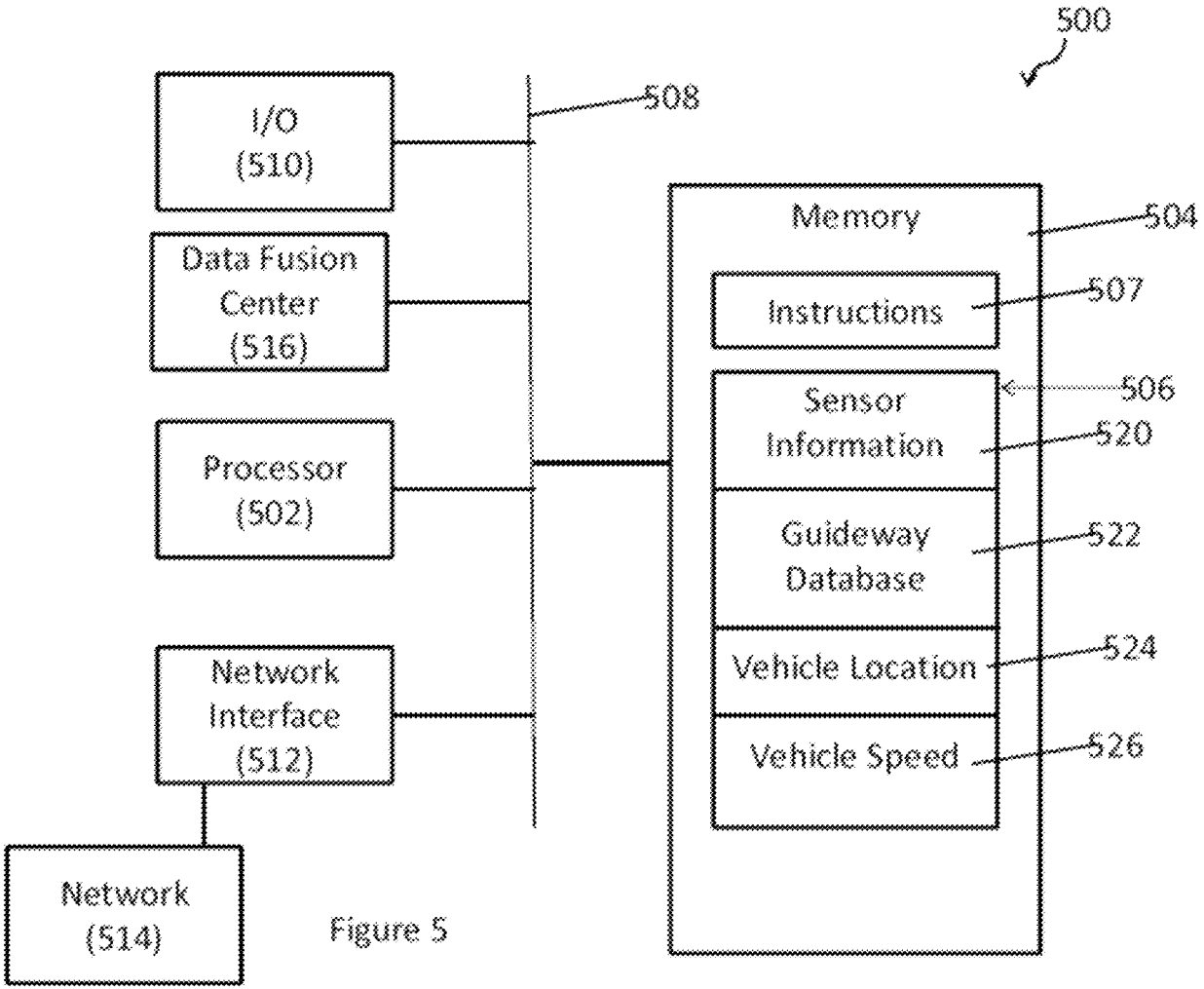
FIG. 5 is a block diagram of a vehicle on-board controller (VOBC) for using a fusion sensor arrangement in accordance with one or more embodiments.

FIG. 5 is a block diagram of a VOBC 500 for using a fusion sensor arrangement in accordance with one or more embodiments. VOBC 500 includes a hardware processor 502 and a non-transitory, computer readable storage medium 504 encoded with, i.e., storing, the computer program code 506, i.e., a set of executable instructions. Computer readable storage medium 504 is also encoded with instructions 507 for interfacing with manufacturing machines for producing the memory array. The processor 502 is electrically coupled to the computer readable storage medium 504 via a bus 508. The processor 502 is also electrically coupled to an I/O interface 510 by bus 508. A network interface 512 is also electrically connected to the processor 502 via bus 508. Network interface 512 is connected to a network 514, so that processor 502 and computer readable storage medium 504 are capable of connecting to external elements via network 514. VOBC 500 further includes data fusion center 516. The processor 502 is connected to data fusion center 516 via bus 508. The processor 502 is configured to execute the computer program code 506 encoded in the computer readable storage medium 504 in order to cause system 500 to be usable for performing a portion or all of the operations as described in method 300 or method 400.

In some embodiments, the processor 502 is a central processing unit (CPU), a multi-processor, a distributed processing system, an application specific integrated circuit (ASIC), and/or a suitable processing unit.

In some embodiments, the computer readable storage medium 504 is an electronic, magnetic, optical, electromagnetic, infrared, and/or a semiconductor system (or apparatus or device). For example, the computer readable storage medium 504 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 504 includes a compact disk-read only memory (CD-ROM), a compact disk-read/write (CD-R/W), and/or a digital video disc (DVD).

In some embodiments, the storage medium 504 stores the computer program code 506 configured to cause system 500 to perform method 300 or method 400. In some embodiments, the storage medium 504 also stores information needed for performing a method 300 or 400 as well as information generated during performing the method 300 or 400, such as a sensor information parameter 520, a guideway database parameter 522, a vehicle location parameter 524, a vehicle speed parameter 526 and/or a set of executable instructions to perform the operation of method 300 or 400.

In some embodiments, the storage medium 504 stores instructions 507 for interfacing with manufacturing machines. The instructions 507 enable processor 502 to generate manufacturing instructions readable by the manufacturing machines to effectively implement method 400 during a manufacturing process.

VOBC 500 includes I/O interface 510. I/O interface 510 is coupled to external circuitry. In some embodiments, I/O interface 510 includes a keyboard, keypad, mouse, trackball, trackpad, and/or cursor direction keys for communicating information and commands to processor 502.

VOBC 500 also includes network interface 512 coupled to the processor 502. Network interface 512 allows VOBC 500 to communicate with network 514, to which one or more other computer systems are connected. Network interface 512 includes wireless network interfaces such as BLUETOOTH, WIFI, WIMAX, GPRS, or WCDMA; or wired network interface such as ETHERNET, USB, or IEEE-1394. In some embodiments, method 300 or 400 is implemented in two or more VOBCs 500, and information such as memory type, memory array layout, I/O voltage, I/O pin location and charge pump are exchanged between different VOBCs 500 via network 514.

VOBC further includes data fusion center 516. Data fusion center 516 is similar to data fusion center 130 (FIG. 1). In the embodiment of VOBC 500, data fusion center 516 is integrated with VOBC 500. In some embodiments, the data fusion center is separate from VOBC 500 and connects to the VOBC through I/O interface 510 or network interface 512.

VOBC 500 is configured to receive sensor information related to a fusion sensor arrangement, e.g., fusion sensor arrangement 100 (FIG. 1), through data fusion center 516. The information is stored in computer readable medium 504 as sensor information parameter 520. VOBC 500 is configured to receive information related to the guideway database through I/O interface 510 or network interface 512. The information is stored in computer readable medium 504 as guideway database parameter 522. VOBC 500 is configured to receive information related to vehicle location through I/O interface 510, network interface 512 or data fusion center 516. The information is stored in computer readable medium 504 as vehicle location parameter 524. VOBC 500 is configured to receive information related to vehicle speed through I/O interface 510, network interface 512 or data fusion center 516. The information is stored in computer readable medium 504 as vehicle speed parameter 526.

During operation, processor 502 executes a set of instructions to determine the location and speed of the guideway mounted vehicle, which are used to update vehicle location parameter 524 and vehicle speed parameter 526. Processor 502 is further configured to receive LMA instructions and speed instructions from a centralized or de-centralized control system, e.g., control system 460. Processor 502 determines whether the received instructions are in conflict with the sensor information. Processor 502 is configured to generate instructions for controlling an acceleration and braking system of the guideway mounted vehicle to control travel along the guideway.

Figure 6:
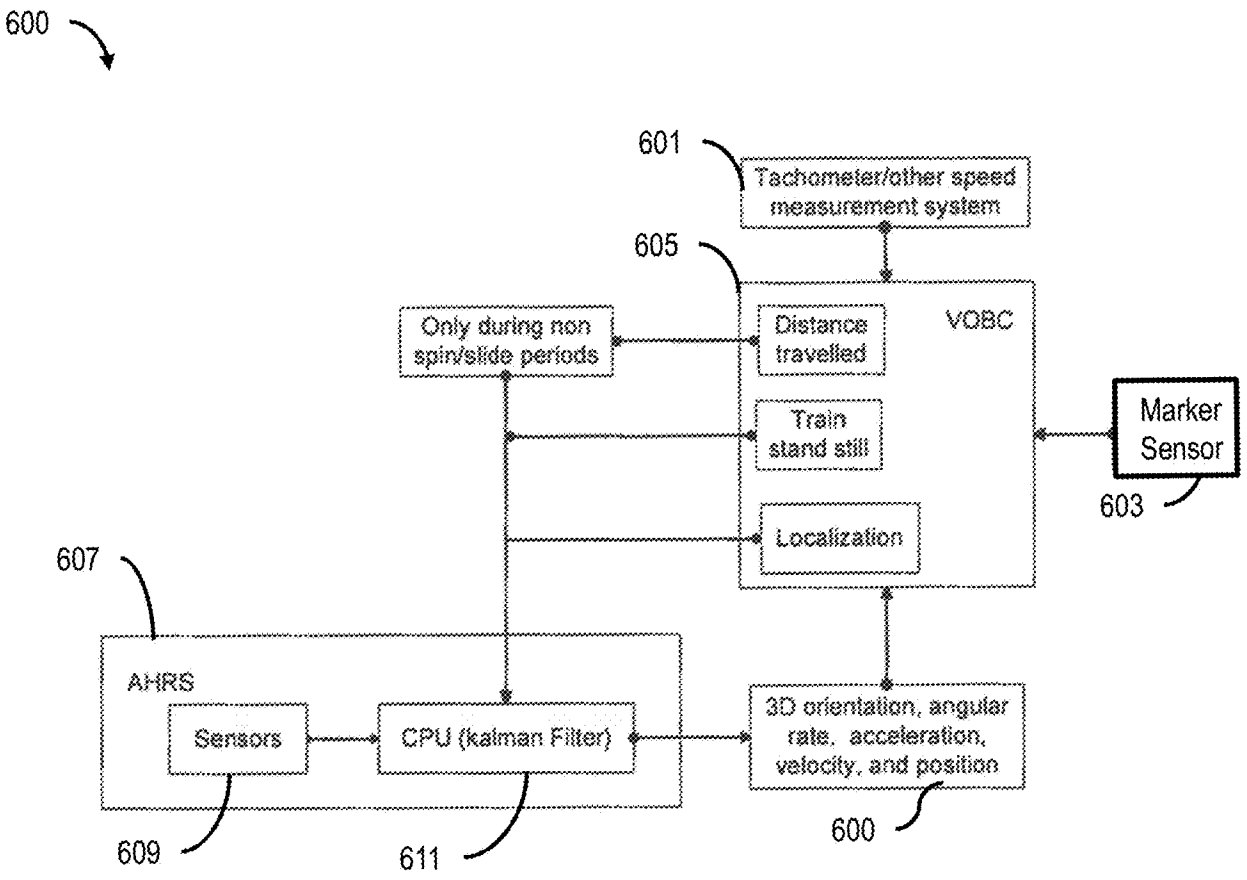
FIG. 6 is a block diagram of a system for determining a position of a guideway mounted vehicle, in accordance with one or more embodiments.

FIG. 6 is a block diagram of a system 600 for determining a position of a guideway mounted vehicle such as guideway mounted vehicle 202 (FIG. 2), in accordance with one or more embodiments.

System 600 comprises a speed detector 601, a marker sensor 603, a controller 605, and an Attitude and Heading Reference System (AHRS) 607.

Speed detector 601 is configured to generate speed data associated with a movement of the vehicle. In some embodiments, speed detector 601 is a tachometer configured to detect a rotational speed of a wheel of the guideway mounted vehicle. In some embodiments, speed detector 601 is a global positioning system (GPS) unit or receiver capable of providing speed related information. In some embodiments, speed detector 601 is some other suitable detector, sensor or system, configured to provide speed related data associated with a movement of the vehicle.

Marker sensor 603 is configured to generate marker data based on a detection of an object along a wayside of a guideway along which the vehicle is configured to move. In some embodiments, the object is a marker. A marker is, for example, a transponder tag detectable by a reader, a cross-over/loop boundary, a static object such as a sign or a shape that has a location that is known to the VOBC, an object that is detectable by way of a fusion sensor such as fusion sensor arrangement 100 (FIG. 1), a distinct or sharp change in one or more guideway properties (e.g. direction, curvature, or other identifiable property) which can be accurately associated with a specific location, or other suitable detectable feature or object usable to determine a geographic location of a vehicle.

In some embodiments, the marker sensor 603 comprises one or more of an RFID reader, an RF transponder, a fusion sensor arrangement such as fusion sensor arrangement 100 (FIG. 1), or other suitable sensor usable to detect a change in a guideway property such as direction, curvature, or other recognizable property associated with the guideway. In some embodiments, the marker data comprises data usable by the controller 605 to determine the geographic location of the vehicle in terms of a geographic coordinate system (e.g., latitude, longitude, and/or altitude).

Controller 605 is coupled with the speed detector 601 and the marker sensor 603. Controller 605 is configured to calculate a distance the vehicle moved based on the speed data and the marker data. Controller 605 is also configured to generate location information based on the distance the vehicle moved and the marker data. Controller 605 is further configured to generate an indication that the vehicle is stationary based on the speed data. In some embodiments, controller 605 autonomously determines vehicle location, speed and direction of movement along the guideway. In some embodiments, controller 605 is a VOBC such as VOBC 500 (FIG. 5).

In some embodiments, controller 605 is configured to provide the AHRS 607 with one or more of the speed data, the marker data, the geographic location (e.g., latitude, longitude, and altitude) of the marker determined by the controller 605, an orientation (e.g., azimuth/heading, grade/pitch, or bank/roll angles) of the guideway where the detected marker resides, the distance that the vehicle moved from a last marker as determined by controller 605 based on the speed data and/or an indication that the vehicle is stationary. The controller 605 is configured to determine that the vehicle is stationary based on the speed data or an instruction that indicates that the vehicle speed is equal to zero. In some embodiments, the controller 605 is configured to determine that the vehicle is stationary based on an instruction that indicates an amount of propulsion or force produced by a propulsion system configured to cause the guideway mounted vehicle to move is equal to zero.

AHRS 607 is an inertial navigation system that is configured to generate an accurate dead reckoning navigation solution between detected markers. In some embodiments, the dead reckoning navigation solution generated by the AHRS 607 is a 3D navigation solution. AHRS 607 comprises a sensor unit 609 and a processor 611. Processor 611 is coupled with sensor unit 609 and with controller 605. In some embodiments, the processor 611 and the sensor unit 609 are implemented as a microelectromechanical system (MEMS) based AHRS that is coupled with the controller 605 or included in the controller 605. In some embodiments, the sensor unit 609 and the processor 611 are self-calibrating. In some embodiments, sensor unit 609 and processor 611 are individual components of the system 600. For example, in some embodiments, system 600 comprises a sensor unit 609 and a processor 611 without the sensor unit 609 and the processor 611 being embodied in an AHRS.

Sensor unit 609 comprises an accelerometer, a gyroscope, and a magnetometer. In some embodiments, sensor unit 609 comprises a temperature sensor or other suitable sensor. Sensor unit 609 is configured to generate sensor data based on information gathered by one or more of the accelerometer, the gyroscope, the magnetometer or the temperature sensor. In some embodiments, sensor unit 609 comprises more than one accelerometer, gyroscope, or magnetometer. In some embodiments, sensor unit 609 comprises three accelerometers, three gyroscopes, and three magnetometers. In some embodiments, sensor unit 609 comprises one or more temperature sensors. In some embodiments, one or more of the accelerometer(s), the gyroscope(s), or the magnetometer(s) is a multi-axis accelerometer, a multi-axis gyroscope, or a multi-axis magnetometer. In some embodiments, the sensor unit 609 comprises three dual-axis accelerometers, three dual-axis gyroscopes, and three dual-axis magnetometers. In some embodiments, one or more of the accelerometer(s), the gyroscope(s), or the magnetometer(s) is a three-axis accelerometer, a three-axis gyroscope, or a three-axis magnetometer. Processor 611 is configured to process the sensor data to determine a vehicle position based on the sensor data and the location information.

In some embodiments, once AHRS 607 is initialized in terms of position, speed, and orientation, AHRS 607 is configured to determine the 3D navigation solution independently by double integration of a measured acceleration (dead reckoning) in all three axes (e.g., Local North-East-Down). As a result, once a single marker is detected, a full 3D navigation solution is provided for use by the controller 605 to establish the location information train position and the direction of movement of the vehicle along the guideway. In some embodiments, the 3D navigation solution comprises one or more of a vehicle position in terms of AHRS body coordinates, a vehicle velocity in terms of AHRS body coordinates, a vehicle acceleration in terms of AHRS body coordinates, a vehicle orientation in local North-East-Down coordinates, or an angular rate in local North-East-Down coordinates. In some embodiments, AHRS body coordinates are defined as (1) X—forward along the vehicle's "waterline", (2) Y—left perpendicular to the vehicle's "waterline", and (3) Z—down perpendicular to the train's "waterline". In some embodiments, the local North-East-Down coordinates are defined as (1) North—toward the earth's local magnetic north, (2) East—toward east corresponding to the earth's local magnetic north, and (3) Down—toward the earth's center of gravity.

In some embodiments, processor 611 processes the sensor data via a filtering algorithms such as a Kalman filter to generate the 3D navigation solution. The 3D navigation solution includes an orientation, angular rate, acceleration, velocity, and position of the guideway mounted vehicle. In some embodiments, the orientation and/or the angular rate are determined with respect to the guideway. In some embodiments, the processor 611 processes data from an external system or sensor such as the distance the vehicle moved as determined by the controller 605, the location information determined by the controller 605, or raw data provided to the processor 611 such as the speed data generated by the speed detector 601 to generate one or more components of the 3D navigation solution. In some embodiments, the processor 611 is configured to receive and process speed data generated by a tachometer, a non-wheel based speed measurement system, a GPS, and/or other suitable localization system or sensor to generate one or more components of the 3D navigation solution. In some embodiments, processor 611 is configured to receive and process raw data such as marker data generated by marker sensor 603 to generate one or more components of the 3D navigation solution. In some embodiments, processor 611 is configured to receive and process marker data or localization data generated by a transponder tag interrogator (e.g., an RFID reader), a fusion sensor, or other suitable localization system or sensor usable to determine a specific guideway location to generate one or more components of the 3D navigation solution.

In some embodiments, the 3D navigation solution is provided to the controller 605 in two sets. A first 3D navigation solution set is a compensated 3D navigation solution based on the distance the vehicle moved as determined by the controller 605 and the speed data supplied by the controller 605. The second 3D navigation solution set is a non-compensated 3D navigation solution that is not compensated based on the distance the vehicle moved as determined by the controller 605 and the speed data supplied by the controller 605. In some embodiments, the compensated 3D navigation solution set and the non-compensated 3D navigation solution set are provided to the controller 605 simultaneously.

Because the processor 611 is configured to process the sensor data, the location information, and/or raw speed data, marker data, or other localization information, the processor 611 is capable of generating a vehicle position that has a minimal positioning error as a result of integration drift. Integration drift sometimes occurs in vehicle positioning solutions if the position of the vehicle is determined based on accelerometers, tachometer, and marker data alone. In some embodiments, AHRS 607 is configured to control an integration drift less than a threshold value that is dependent upon the overall required system throughput (ex. Less than or equal to 30 meters after one minute of dead reckoning) to maintain a positioning error within expected bounds. In some embodiments, AHRS 607 is configured to provide dead reckoning positioning re-localization based on an external marker such as a transponder tag to minimize the positioning error when an external marker is detected. In some embodiments, AHRS 607 is configured to provide dead reckoning positioning compensation based on external source data, such as GPS data or a distance the vehicle moved determined by the controller 605 based on the speed data to minimize the positioning error during dead reckoning. In some embodiments, the AHRS 607 is configured to improve the navigation solution and its associated positioning error based on specific constraints applied to the railway system by implementing static navigation solution constraints such as a zero speed (for the Y and Z axis in the AHRS body coordinates). In some embodiments, the AHRS 607 is configured to avoid unnecessary accumulation of positioning error when the train is stopped by implementing dynamic navigation solution constraints such as zero speed (for the X axis in the AHRS system body coordinates). In some embodiments, when the vehicle comes to a stop, and stand still conditions are verified, the controller 605 is configured to update the AHRS 607 accordingly. The AHRS 607 uses the stand still indication received form the controller 605 to eliminate drift errors during the period that the vehicle does not move.

Because the processor 611 generates a full 3D navigation solution, the direction that the vehicle moves on the guideway is capable of being established upon generation of the 3D navigation solution. Because the 3D navigation solution is based, at least in part, on the sensor data generated by the sensor unit 609, the processor 611 and/or the controller 605 are capable of generating the vehicle position and/or the location information describing the position of the vehicle on the guideway once a single marker is observed. By establishing the position of the vehicle on the guideway after a single marker is observed, the controller 605 is able to maintain operation of the vehicle if a marker is missed, which is sometimes a problem in conventional vehicle localization systems that depend on observing two adjacent consecutive transponder tags to establish the position of the vehicle and the direction of movement of the vehicle on the guideway. In some embodiments, each time a marker is observed, processor 611 is configured to localize or re-localize the vehicle position included in the 3D navigation solution.

Controller 605 is configured to update the location information based on at least the vehicle position included in the 3D navigation solution and to determine a direction that the vehicle moved based on the updated location information. In some embodiments, the controller 605 uses the 3D navigation solution to determine the direction that the vehicle moved.

After the marker sensor 603 detects an object or marker, controller 605 periodically updates the processor 611 with the distance traveled based on the speed data. In some embodiments, controller 605 is configured to update processor 611 with the distance traveled about every 70 milliseconds (msec). In some embodiments, controller 605 is configured to update processor 611 with the distance traveled more often than about every 70 msec. In other embodiments, controller 605 is configured to update processor 611 with the distance traveled less often than about every 70 msec.

Using the location information and the distance traveled provided by the controller 605, processor 611 generates the 3D navigation solution and communicates the 3D navigation solution to the controller 605 multiple times every second. In some embodiments, controller 605 is configured to compare the direction that the vehicle moved with an expected direction of travel based on guideway data stored in a memory, and the controller 605 is configured to determine the vehicle is off the guideway based on a change in the direction that the vehicle moved from the expected direction of travel if the change in the direction that the vehicle moved occurred within a predetermined period of time. In some embodiments, the predetermined period of time is less than or equal to the period within which the processor 611 updates controller 605 or the controller 605 updates processor 611.

In some embodiments, controller 605 is configured to compare the location information with the vehicle position generated by the processor 611 to determine if a difference between the location information and the vehicle position is within a predetermined threshold range. In some embodiments, controller 605 is configured to compare the distance traveled based on the speed data with a distance traveled based on the 3D navigation solution to determine if the difference is within a predetermined threshold range. If the difference between either the vehicle position and the location information or the distance traveled based on the speed data and the distance traveled based on the 3D navigation solution is outside the threshold range, the difference indicates that one of the vehicle position, the location information, the distance traveled based on the speed data or the distance traveled based on the 3D navigation solution is implausible or incorrect.

In some embodiments, an implausible or incorrect 3D navigation solution is indicative that a slip or slide condition has occurred. A slip condition is a situation in which a wheel of the vehicle slips or spins with respect to the guideway and the vehicle moves a distance that is less than a distance that corresponds with the amount the wheel spins based on a diameter of the wheel. A slide condition is a situation in which a wheel of the vehicle slides with respect to the guideway and the vehicle moves a distance that is greater than a distance that corresponds with the amount the wheel spins based on the diameter of the wheel. If the difference is outside the threshold range, the controller 605 is configured to generate an indication that a slip or slide condition has occurred. In some embodiments, the controller 605 is configured to determine that the vehicle is in a slide condition based on an indication that the vehicle is stationary based on the speed data and an indication that the vehicle changed position based on the sensor data from a first position to a second position different from the first position.

In some embodiments, the controller 605 is configured to determine a velocity and an acceleration of the vehicle based on the speed data. The controller 605 compares the velocity and the acceleration portions of the non-compensated 3D navigation solution set provided to the controller 605 by the processor 611 with the velocity and acceleration determined based on the speed data to identify if the vehicle is in a slip or a slide condition.

Based on the comparison, the controller 605 is configured to determine that the vehicle is in a slip or a slide condition if the velocity and/or the acceleration portions of the non-compensated 3D navigation solution set and the corresponding velocity and/or the acceleration determined based on the speed data are mismatched by more than the acceptable range for a non-slip/slide state.

If a slip or a slide condition is determined to have occurred, the controller 605 is configured to prevent transmission of one or more of the location information or the distance the vehicle moved that is calculated based on the speed data to the processor 611. By preventing transmission of the location information and/or the distance traveled to the processor 611, the processor 611, is caused to generate the 3D navigation solution based on the sensor data alone or in combination with the location information. In some embodiments, if the controller 605 determines the vehicle is in a slip or a slide condition, the controller 605 is configured to stop sending the location information, the distance the vehicle moved from the last marker and/or the speed data to the processor 611. In some embodiments, as a result, the compensated and the non-compensated 3D navigation solution sets will then be identical.

If a slip or slide condition is determined by the controller 605 to have occurred, then the controller 605 is configured to determine the location information and/or the distance the vehicle moved based on the 3D navigation solution or one or more components thereof such as the vehicle position generated by the processor 611 until a marker is detected by the marker sensor 603. For example, if the marker data is based on a first object detected by the marker sensor 603, then the controller 605 is configured to determine the location information based only on the vehicle position generated by the processor 611 if a slip or slide condition is determined to have occurred until a second object is detected by the marker sensor 603. Because the slip or slide condition is tolerated until the marker sensor 603 detects another object, a quantity of markers needed to keep a vehicle in operation on the guideway is capable of being reduced. For example, the system 100 makes it possible to optionally place markers at locations along the guideway where high vehicle position accuracy is desired such as at switch zones or platforms.

The controller 605 is configured to determine the slip or slide condition has ended if the non-compensated 3D navigation solution set and the velocity and acceleration determined based on the speed data are within the acceptable range for the non-slip/slide state. After the controller 605 determines the slip or the slide condition has ended, the controller 605 starts sending the location information, the distance the vehicle moved from the last marker and/or the speed data to the processor 611 again.

During non-slip or slide periods, the 3D navigation solution is "corrected" by the distance traveled calculated by the controller 605 based on the speed data. This ensures that the 3D navigation solution, during the non-slip or slide periods, is at least as accurate as the distance traveled calculated by controller 605.

Because the position error due to integration drift over time is minimized by the AHRS 607, the controller 605 is capable of tolerating periods in which the vehicle is in a slip or slide condition without exceeding a position uncertainty limit that would otherwise affect the operation of the vehicle. In vehicle localization systems that determine a vehicle position based on accelerometers, tachometers and marker data alone, vehicle positioning uncertainty grows rapidly during periods in which the vehicle is in a slip or a slide condition, which results in a position being lost when a maximum position uncertainty threshold is exceeded. AHRS 607 makes it possible to tolerate a slip or slide period or distance because the location information and the vehicle position determined by the controller 605 and the processor 611 are updated based on the sensor data, which helps to keep the position uncertainty below the maximum positioning uncertainty threshold following a slip or slide condition before another marker is detected to update the location information generated by the controller 605.

In some embodiments, controller 605 is configured to determine the vehicle is off the guideway. In some embodiments, if the vehicle is determined to be off the guideway, then the controller 605 determines that a derailment of the vehicle from the guideway has occurred. If the vehicle is determined to be off the guideway, the controller 605 is configured to generate an indication that the vehicle is off the guideway. Based on the determination that the vehicle is off the guideway, in some embodiments, the controller 605 is configured to stop the vehicle from operating. For example, if the controller 605 determines the vehicle is off the guideway, the controller 605 is configured to cause the wheels of the vehicle to stop moving. Such a feature is helpful in preventing a vehicle that is off the guideway from being driven from a derailment position to another position by way of a force generated by the wheels of the vehicle, for example. In other words, the controller 605 is configured to generate an instruction to cut off vehicle propulsion.

In some embodiments, the controller 605 is configured to determine the vehicle is off the guideway based on a change in the orientation from an expected orientation of the vehicle that occurs within a predetermined period of time. For example, if the processor 611 is configured to communicate the 3D navigation solution to the controller 605 about every 70 msec, and the controller is configured to update the processor 611 with the location information and/or the distance traveled every 70 msec, then an unexpected change in orientation of the vehicle that occurs in less than about 140 msec is indicative that the vehicle has unexpectedly moved off of the guideway. In some embodiments, the predetermined period of time is greater than about 140 msec. The expected orientation of the vehicle is one or more of a current orientation of the vehicle with respect to the guideway determined by the processor 611 or an orientation of the vehicle with respect to the guideway associated with a known position on the guideway that is stored in a memory. Controller 605 is configured to compare the orientation of the vehicle with the expected orientation of the vehicle, to determine if an unexpected change in the orientation of the vehicle occurs within the predetermined period of time. In some embodiments, the predetermined period of time provides as small of a window as possible to provide a near instantaneous determination that an unexpected change in orientation of the vehicle has occurred. For example, upon an unexpected derailment of the vehicle from the guideway, the vehicle position and the orientation of the vehicle will have a sudden and significant change. For example, in a case of a vehicular rollover from an upright position with respect to the guideway to a side of the vehicle, the vehicle will experience a roll angle of about 90 degrees. In some cases in which the vehicle is unexpectedly off the guideway, the heading angle will have a significant change with respect to the guideway heading. In some other cases, the vehicle position may be significantly off the guideway location.

In some embodiments, controller 605 is configured to determine that the vehicle is off the guideway based on the change in the orientation of the vehicle and a decrease in acceleration based on the sensor data. For example, if the controller 605 determines that a change in the orientation of the vehicle has occurred and, based on the speed data or the 3D navigation solution, the vehicle suddenly decelerates with an instruction known to the controller 605, the controller determines that the vehicle is off the guideway.

In some embodiments, if the vehicle is not in a slip or a slide condition, e.g., the difference between the vehicle position and the location information is within the threshold range, the controller 605 is configured to calibrate a diameter of a wheel of the vehicle based on the vehicle position, the marker data, and the speed data. The distance traveled based on speed data such as that generated by a tachometer is a function of the wheel diameter. Therefore, accurate speed data measurement relies on accurate calibration of the wheel diameter. Typically calibration is performed by adjusting the wheel diameter based on a known distance between two known markers and a number of tachometer pulses measured between the two known markers. The wheel calibration accuracy is sensitive to marker detection errors (e.g. transponder detection errors, installation errors, footprint) and spin/slide related errors. To improve the accuracy of the wheel calibration and to increase the tolerance for some detection errors, the controller 605 is configured to calibrate the diameter of the wheel using the vehicle position generated by the processor 611, which is based on the sensor data. The controller 605 is then able to determine the location information based on the speed data and the calibrated diameter of the wheel. In some embodiments, the wheel diameter calibration is based on the difference between two AHRS inputs in proximity to the detected object or marker. In some embodiments, the AHRS 607 is configured to specifically communicate with objects or markers that are marked with calibration tags to perform the wheel diameter calibration.

Figure 7:
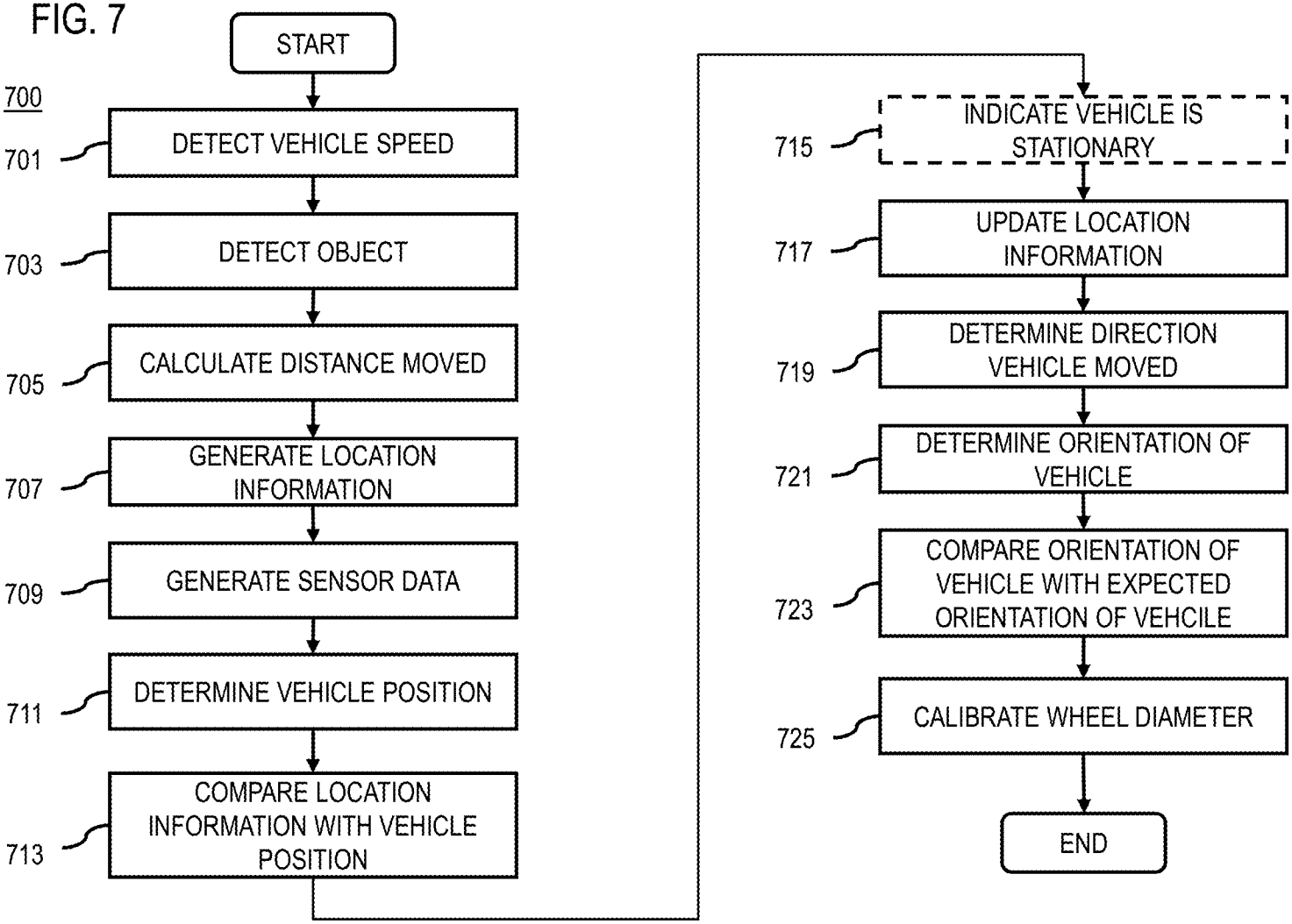
FIG. 7 is a flowchart of a method of determining a position of a guideway mounted vehicle, in accordance with one or more embodiments.

FIG. 7 is a flowchart of a method 700 of determining a position of a guideway mounted vehicle, in accordance with one or more embodiments. In some embodiments, one or more steps of method 700 is implemented by a processor such as processor 611 (FIG. 6) or a controller such as 605 (FIG. 6).

In step 701, a speed of a vehicle is detected using a speed detector configured to generate speed data associated with the vehicle.

In step 703, an object is detected along a wayside of a guideway along which the vehicle is configured to move using a marker sensor configured to generate marker data based on the detection of the object.

In step 705, the controller calculates a distance the vehicle moved based on the speed data and the marker data.

In step 707, the controller generates location information based on the distance the vehicle moved and the marker data.

In step 709, sensor data is generated based on information gathered by one or more of an accelerometer, a gyroscope, or a magnetometer.

In step 711, the processor processes the sensor data using to determine a vehicle position based on the sensor data and the location information.

In step 713, the controller compares the location information with the vehicle position to determine if a difference between the location information and the vehicle position is within a predetermined threshold range. If the difference is outside the threshold range, the controller determines the vehicle is in a slip or slide condition. Based on the determination that the vehicle is in a slip or a slide condition, the controller prevents transmission of the location information to the processor. If the controller determines that the vehicle is in a slip or a slide condition, the controller determines the location information based only on the vehicle position provided by the processor.

In step 715, the controller optionally generates an indication that the vehicle is stationary based on the speed data. The controller is configured to determine the vehicle is in a slide condition based on the indication that the vehicle is stationary based on the speed data and a change in vehicle position based on the sensor data from a first position to a second position different from the first position.

In step 717, the controller updates the location information based on the vehicle position.

In step 719, the controller determines a direction the vehicle moved based on the updated location information. The controller compares the direction that the vehicle moved with an expected direction of travel based on guideway data stored in a memory. If a change in the direction that the vehicle moved from the expected direction of travel occurred within a predetermined period of time, the controller determines the vehicle is off the guideway.

In step 721, the processor processes orientation data associated with an orientation of the vehicle included with the sensor data to determine an orientation of the vehicle with respect to the guideway.

In step 723, the controller compares the orientation of the vehicle with an expected orientation of the vehicle. The expected orientation of the vehicle is one or more of a current orientation of the vehicle determined by the processor or a stored orientation of the vehicle associated with the guideway. If the controller determines that the vehicle unexpectedly changed orientation within a predetermined period of time, the controller determines the vehicle is off the guideway. In some embodiments, the controller determines that the vehicle is off the guideway based on the change in the orientation of the vehicle and a decrease in acceleration based on the sensor data.

In step 725, the controller calibrates a diameter of a wheel of the vehicle based on the vehicle position, the marker data, and the speed data. The location information is based on the speed data and the calibrated diameter of the wheel if the difference is within the threshold range, indicating the vehicle is not in a slip or a slide condition.

Figure 8:
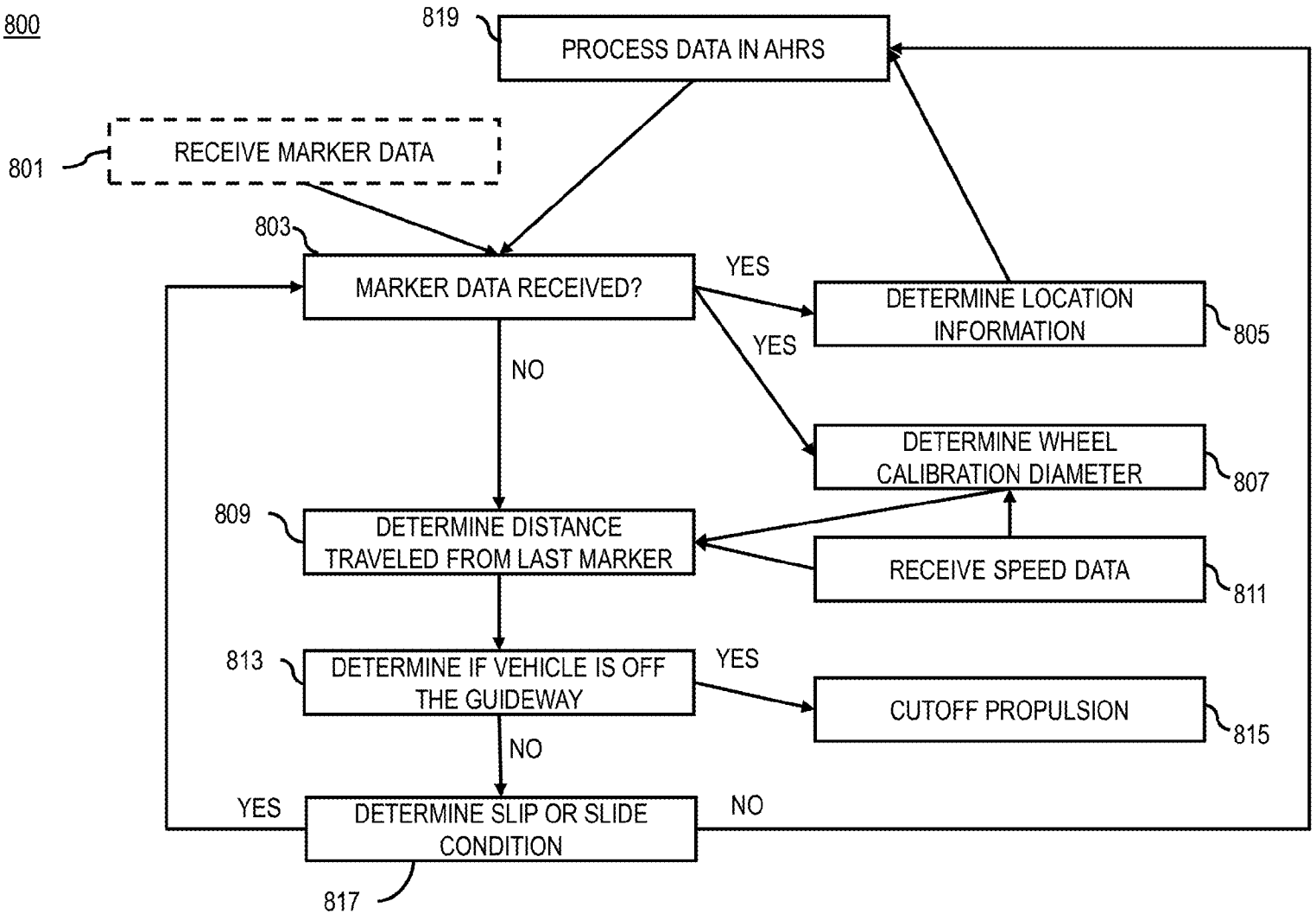
FIG. 8 is a functional flowchart of a method for integrating an Attitude and Heading Reference System (AHRS) into a VOBC positioning system, in accordance with one or more embodiments.

FIG. 8 is a functional flowchart of a method 800 for integrating an AHRS into a VOBC positioning system, in accordance with one or more embodiments. In some embodiments, one or more steps of method 800 is implemented by a processor such as processor 611 (FIG. 6) of AHRS 607 (FIG. 6) or a controller such as 605 (FIG. 6).

In step 801, marker data is optionally received by the controller. In step 803, the controller determines if marker data was received. If yes, the method continues to steps 805 and 807. If no, then the method continues to step 809.

In step 805, the controller determines the location of the vehicle based on the marker data and communicates the location information to the processor of the AHRS in terms of the location of the marker.

In step 807, the controller calibrates the wheel diameter based on the marker data and the speed data received by the controller in step 811.

In step 811, speed data is received by the controller. The speed data is usable, for example, to determine the distance the vehicle traveled from the last marker and/or for wheel diameter calibration.

In step 809, the controller determines the distance the vehicle traveled from the last marker detected based on the received marker data associated with detecting the last marker, the speed data, and the calibrated wheel diameter.

In step 813, the controller determines if the vehicle is off the guideway. If yes, then the controller cuts off propulsion of the vehicle in step 815. If no, then the method continues to step 817 in which the controller determines if the vehicle is in a slip or a slide condition. If yes, the method continues to step 803 to re-initialize the position of the vehicle. If no, then the process continues to step 819, and the controller communicates the distance that the vehicle traveled from the last marker to the AHRS.

In step 819, the AHRS processes the marker location, the vehicle location, the distance the vehicle traveled, the speed data, and/or the sensor data generated by the sensors of the AHRS to generate the compensated 3D navigation solution and the non-compensated 3D navigation solution usable to determine the location of the vehicle until a next marker is detected and new marker data is received by the controller.

Figure 9:
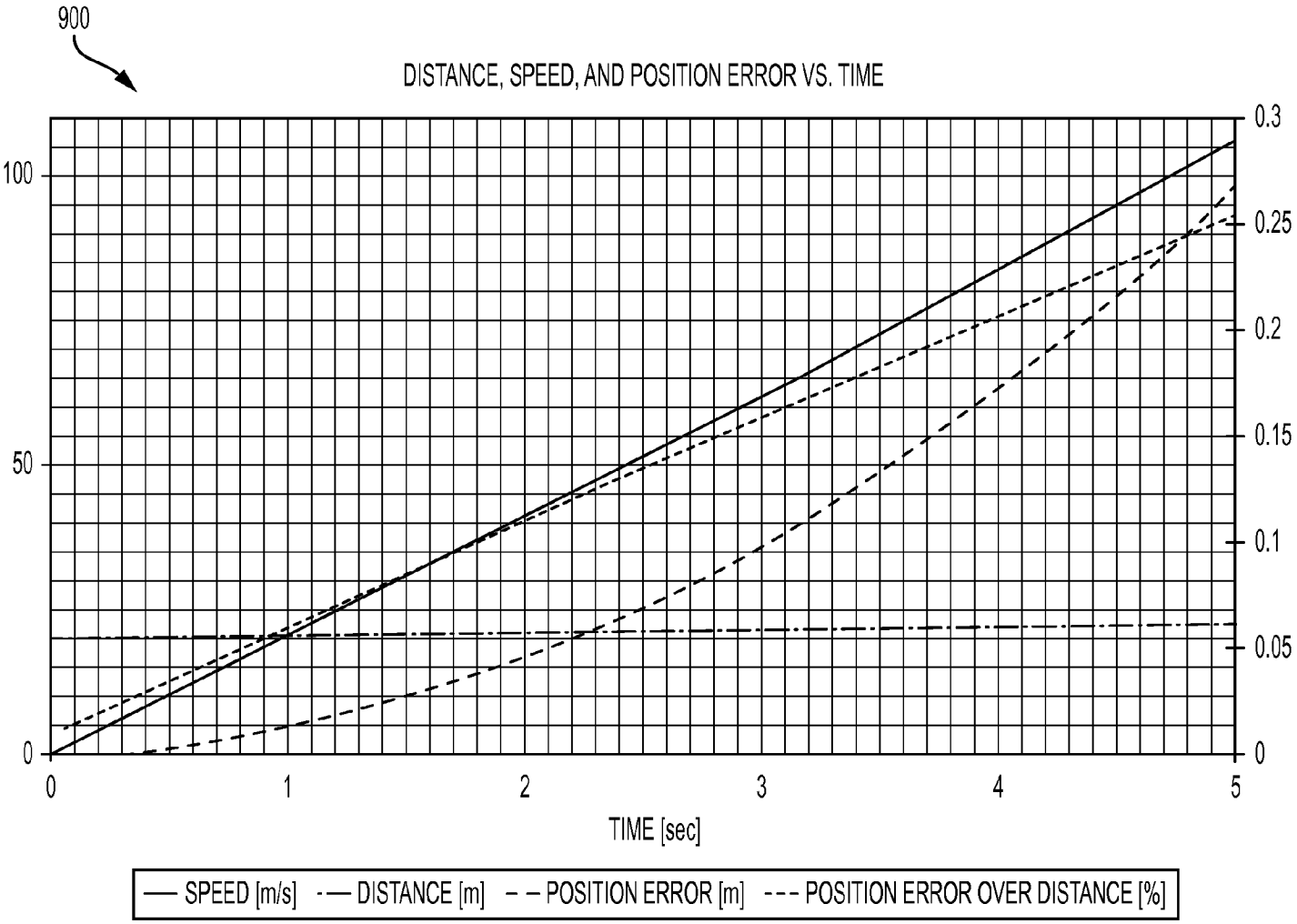
FIG. 9 is a graph showing experimental results demonstrating the effectiveness of the system described with respect to FIG. 6 at reducing wheel calibration errors, in accordance with one or more embodiments.

FIG. 9 is a graph 900 showing experimental results demonstrating the effectiveness of the system 600 at reducing wheel calibration errors, in accordance with one or more embodiments. Graph 900 depicts the distance traveled (m), speed (m/s), positioning error (m) and the position error over traveled distance percentage (%) assuming the integration drift is 30 m after one minute, with an initial vehicle speed of 72 km/h and a vehicular acceleration of 0.5 $m/s^2$ on a level guideway.

Based on the above example, a 0.25% wheel diameter error is achievable where the wheel calibration process is constrained to 5.0 seconds and no spin or slide occurs during the wheel calibration process. This results in a position error of 0.25% of the distance traveled from the last observed marker if no spin or slide occurs. For example, if the distance to a next marker is 2 km, and no markers are installed between a first marker and the next marker, the positioning error at the next marker will be 5 m. This is a significant improvement with respect to situations in which the wheel diameter error is more than 1%.

Figure 10:
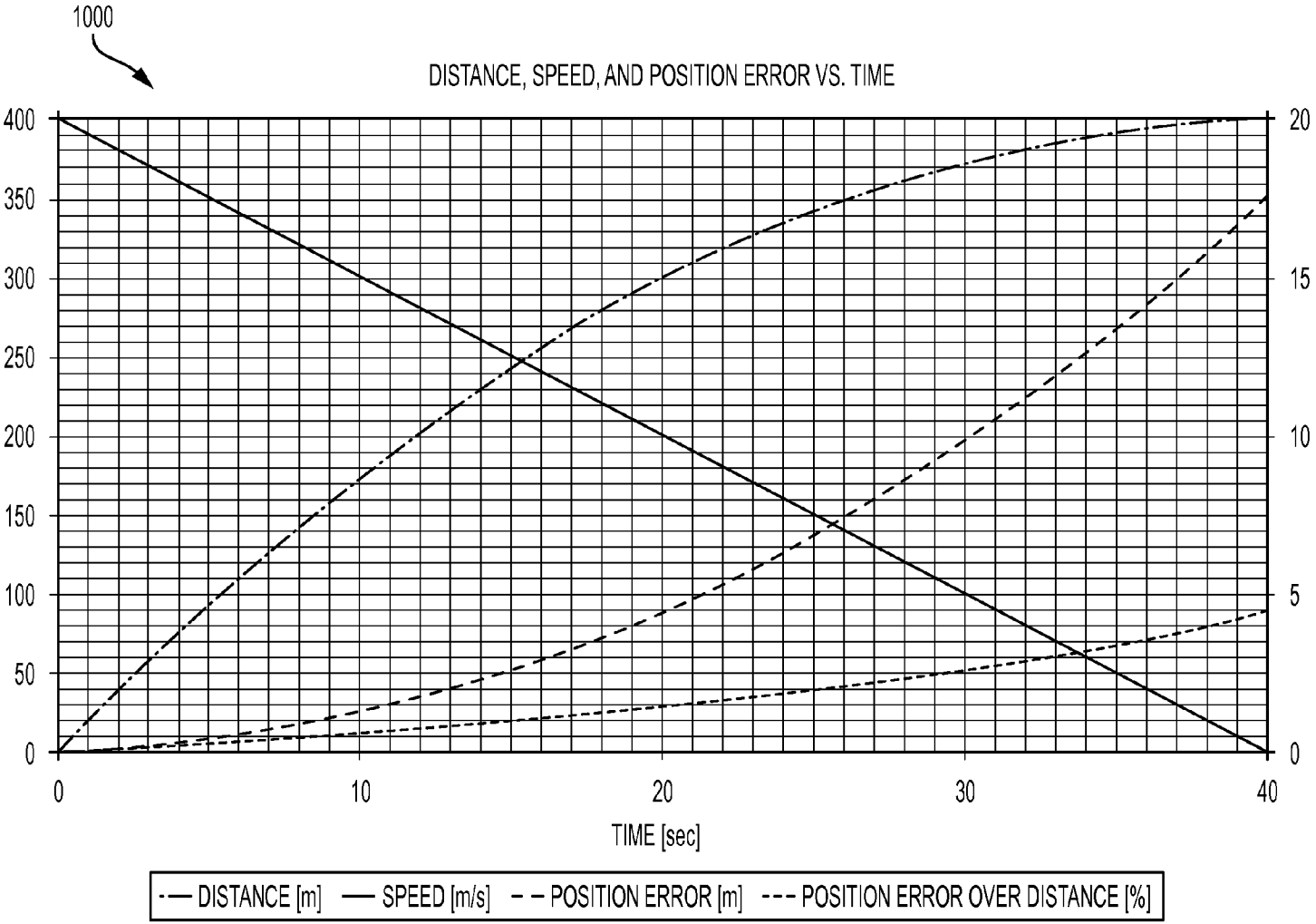
FIG. 10 is a graph showing experimental results demonstrating the effectiveness of the system described with respect to FIG. 6 at reducing drift error in a slide condition, in accordance with one or more embodiments.

FIG. 10 is a graph 1000 showing experimental results demonstrating the effectiveness of the system 600 at reducing drift error in a slide condition, in accordance with one or more embodiments. Graph 1000 depicts the distance traveled (m), speed (m/s), positioning error (m) and the position error over traveled distance percentage (%) assuming the initial vehicle speed is 72 km/h, the vehicle brakes to a stop at 0.5 $m/s^2$ on a level guideway, and a slide occurs. In this example, the braking time is approximately 40 seconds and the positioning error accumulated during the slide period (i.e. 40 seconds) is approximately 18 m. This is a significant improvement with respect to situations in which only few seconds of slide are allowed before the vehicle position is lost to the controller which would usually cause the vehicle to be braked to a stop via an emergency brake actuated by the controller, for example. The above-described systems and methods help make it possible to position transponder tags or other markers, which are used to localize and/or re-localize the train position, only at locations of interest where a smaller position uncertainty is desired. This will result at cost savings as less equipment, if transponder tags are used, has to installed and maintained. The above-described systems and methods help VOBC's to better tolerate slip and or slide conditions that cause position loss. The above-described systems and methods provide a more accurate dead reckoning position between markers as a result of a more accurate wheel diameter calibration process and the 3D navigation solution sets generated by the AHRS. The above-described systems and methods make it possible to detect a train derailment based on the AHRS 3D navigation solution and the determination of a sudden and significant change of the train location and orientation with respect to the expected location and orientation.

An aspect of this description relates to a system comprising a speed detector, a marker sensor, a controller, a sensor unit, and a processor. The speed detector is configured to generate speed data associated with a movement of a vehicle. The marker sensor is configured to generate marker data based on a detection of an object along a wayside of a guideway along which the vehicle is configured to move. The controller is coupled with the speed detector and the marker sensor. The controller is configured to calculate a distance the vehicle moved based on the speed data and the marker data. The controller is also configured to generate location information based on the distance the vehicle moved and the marker data. The controller is further configured to generate an indication the vehicle is stationary based on the speed data. The sensor unit comprising an accelerometer, a gyroscope, and a magnetometer. The sensor unit is configured to generate sensor data based on information gathered by one or more of the accelerometer, the gyroscope, or the magnetometer. The processor is coupled with the sensor unit and the controller. The processor is configured to process the sensor data to determine a vehicle position based on the sensor data and the location information. The controller is additionally configured to compare the location information with the vehicle position to determine if a difference between the location information and the vehicle position is within a predetermined threshold range.

Another aspect of this description relates to a method comprising detecting a speed of a vehicle using a speed detector configured to generate speed data associated with the vehicle. The method also comprises detecting an object along a wayside of a guideway which the vehicle is configured to move using a marker sensor configured to generate marker data based on the detection of the object. The method further comprises calculating, using a controller, a distance the vehicle moved based on the speed data and the marker data. The method additionally comprises generating location information based on the distance the vehicle moved and the marker data. The method also comprises generating sensor data based on information gathered by one or more of an accelerometer, a gyroscope, or a magnetometer. The method further comprises processing the sensor data using a processor to determine a vehicle position based on the sensor data and the location information. The method additionally comprises comparing the location information with the vehicle position to determine if a difference between the location information and the vehicle position is within a predetermined threshold range.

A further aspect of this description relates to a system comprising a tachometer, a marker sensor, a controller, and a navigation unit. The tachometer is configured to generate rotation data associated with a rotation of a wheel of a vehicle. The marker sensor is configured to generate marker data based on a detection of an object along a wayside of a guideway along which the vehicle is configured to move. The controller is coupled with the tachometer and the marker sensor. The controller is configured to calculate a speed at which the vehicle moves based on the rotation data and a diameter of a wheel of the vehicle. The controller is also configured to calculate a distance the vehicle moved based on the speed data and the marker data. The controller is further configured to generate location information based on the distance the vehicle moved and the marker data. The navigation unit comprises a processor, an accelerometer, a gyroscope, and a magnetometer. The navigation unit is configured to generate a vehicle position based on sensor data and the location information. The sensor data is gathered by one or more of the accelerometer, the gyroscope, or the magnetometer. The controller is additionally configured to determine if a difference between the location information and the vehicle position is within a predetermined threshold range, and calibrate the diameter of the wheel based on the vehicle position, the marker data and the speed data if the difference is within the threshold range.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A system, comprising:

a speed detector configured to generate speed data associated with a movement of a vehicle;

a marker sensor configured to generate marker data based on a detection of an object along a wayside of a guideway along which the vehicle is configured to move;

a controller coupled with the speed detector and the marker sensor, the controller being configured to (1) calculate a distance the vehicle moved based on the speed data and the marker data, (2) generate location information based on the distance the vehicle moved and the marker data, and (3) generate an indication the vehicle is stationary based on the speed data;

a sensor unit comprising an accelerometer, a gyroscope, and a magnetometer, the sensor unit being configured to generate sensor data based on information gathered by one or more of the accelerometer, the gyroscope, or the magnetometer; and a processor coupled with the sensor unit and the controller, the processor being configured to process the sensor data to determine a vehicle position based on the sensor data and the location information, wherein the controller is configured to compare the location information with the vehicle position to determine if a difference between the location information and the vehicle position is within a predetermined threshold range.

2. The system of claim 1, wherein the controller is configured to update the location information based on the vehicle position and to determine a direction the vehicle moved based on the updated location information.

3. The system of claim 2, wherein the controller is configured to compare the direction the vehicle moved with an expected direction of travel based on guideway data stored in a memory, and the controller is configured to determine the vehicle is off the guideway based on a change in the direction the vehicle moved from the expected direction of travel if the change in the direction the vehicle moved occurred within a predetermined period of time.

4. The system of claim 1, wherein the sensor data comprises orientation data associated with an orientation of the vehicle with respect to the guideway, the processor is configured to determine the orientation of the vehicle based on the orientation data, the controller is configured to compare the orientation of the vehicle with an expected orientation of the vehicle, the expected orientation of the vehicle being one or more of a current orientation of the vehicle determined by the processor or a stored orientation of the vehicle associated with the guideway, and the controller is configured to determine the vehicle is off the guideway based on a change in the orientation of the vehicle from the expected orientation of the vehicle to the orientation of the vehicle determined by the processor if the change in the orientation of the vehicle occurred within a predetermined period of time.

5. The system of claim 4, wherein the controller is configured to determine the vehicle is off the guideway based on the change in the orientation of the vehicle and a decrease in acceleration based on the sensor data.

6. The system of claim 1, wherein if the difference is outside the threshold range, the controller is configured to prevent transmission of the location information to the processor.

7. The system of claim 6, wherein the controller is configured to generate an indication that a slip or slide condition has occurred based on the difference being outside the threshold range.

8. The system of claim 7, wherein the marker data is based on a first object detected by the marker sensor, and the controller is configured to determine the location information based only on the vehicle position if a slip or slide condition is determined to have occurred until a second object is detected by the marker sensor.

9. The system of claim 1, wherein if the difference is within the threshold range, the controller is configured to calibrate a diameter of a wheel of the vehicle based on the vehicle position, the marker data, and the speed data, and the controller is configured to determine the location information based on the speed data and the calibrated diameter of the wheel.

10. The system of claim 1, wherein the controller is configured to determine the vehicle is in a slide condition based on the indication the vehicle is stationary based on the speed data and a change in vehicle position based on the sensor data from a first position to a second position different from the first position.

11. A method, comprising:

detecting a speed of a vehicle using a speed detector configured to generate speed data associated with the vehicle;

detecting an object along a wayside of a guideway along which the vehicle is configured to move using a marker sensor configured to generate marker data based on the detection of the object;

calculating, using a controller, a distance the vehicle moved based on the speed data and the marker data;

generating location information based on the distance the vehicle moved and the marker data;

generating sensor data based on information gathered by one or more of an accelerometer, a gyroscope, or a magnetometer;

processing the sensor data using a processor to determine a vehicle position based on the sensor data and the location information; and comparing the location information with the vehicle position to determine if a difference between the location information and the vehicle position is within a predetermined threshold range.

12. The method of claim 11, further comprising:

updating the location information based on the vehicle position; and determining a direction the vehicle moved based on the updated location information.

13. The method of claim 12, further comprising:

comparing the direction the vehicle moved with an expected direction of travel based on guideway data stored in a memory; and determining the vehicle is off the guideway based on a change in the direction the vehicle moved from the expected direction of travel if the change in the direction the vehicle moved occurred within a predetermined period of time.

14. The method of claim 11, wherein the sensor data further comprises orientation data associated with an orientation of the vehicle with respect to the guideway, and the method further comprises:

processing the orientation data to determine an orientation of the vehicle with respect to the guideway, comparing the orientation of the vehicle with an expected orientation of the vehicle, the expected orientation of the vehicle being one or more of a current orientation of the vehicle determined by the processor or a stored orientation of the vehicle associated with the guideway; and determining the vehicle is off the guideway based on a change in the orientation of the vehicle from the expected orientation of the vehicle to the orientation of the vehicle determined by the processor if the change in the orientation of the vehicle occurred within a predetermined period of time.

15. The method of claim 14, further comprising:

determining the vehicle is off the guideway based on the change in the orientation of the vehicle and a decrease in acceleration based on the sensor data.

16. The method of claim 11, determining the vehicle is in a slip or slide condition based on the difference being outside the threshold range; and preventing transmission of the location information to the processor based on the determined slip or slide condition.

17. The method of claim 16, wherein the marker data is based on a first object detected by the marker sensor, and the method further comprises:

determining the location information based only on the vehicle position if a slip or slide condition is determined to have occurred; and detecting a second object is detected by the marker sensor.

18. The method of claim 11, further comprising:

calibrating a diameter of a wheel of the vehicle based on the vehicle position, the marker data, and the speed data, wherein the location information is based on the speed data and the calibrated diameter of the wheel if the difference is within the threshold range.

19. The method of claim 11, further comprising:

generating an indication the vehicle is stationary based on the speed data, wherein the controller is configured to determine the vehicle is in a slide condition based on the indication the vehicle is stationary based on the speed data and a change in vehicle position based on the sensor data from a first position to a second position different from the first position.

20. A system, comprising:

a tachometer configured to generate rotation data associated with a rotation of a wheel of a vehicle;

a marker sensor configured to generate marker data based on a detection of an object along a wayside of a guideway along which the vehicle is configured to move;

a controller coupled with the tachometer and the marker sensor, the controller being configured to (1) calculate a speed at which the vehicle moves based on the rotation data and a diameter of a wheel of the vehicle, (2) calculate a distance the vehicle moved based on the speed data and the marker data, and (3) generate location information based on the distance the vehicle moved and the marker data; and a navigation unit comprising a processor, an accelerometer, a gyroscope, and a magnetometer, the navigation unit being configured to generate a vehicle position based on sensor data and the location information, the sensor data being gathered by one or more of the accelerometer, the gyroscope, or the magnetometer, wherein the controller is further configured to determine if a difference between the location information and the vehicle position is within a predetermined threshold range, and calibrate the diameter of the wheel based on the vehicle position, the marker data and the speed data if the difference is within the threshold range.

* * * * *